US011577416B2

(12) United States Patent
Park et al.

(10) Patent No.: US 11,577,416 B2
(45) Date of Patent: Feb. 14, 2023

(54) SHAVER

(71) Applicant: DORCO CO., LTD., Seoul (KR)

(72) Inventors: Young Ho Park, Seoul (KR); Jae Joon Lee, Seoul (KR); Sung Hee Son, Seoul (KR); Shin Hwan Park, Seoul (KR)

(73) Assignee: DORCO CO., LTD., Seoul (KR)

( * ) Notice: Subject to any disclaimer, the term of this patent is extended or adjusted under 35 U.S.C. 154(b) by 0 days.

(21) Appl. No.: 16/462,507

(22) PCT Filed: Nov. 21, 2016

(86) PCT No.: PCT/KR2016/013432
§ 371 (c)(1),
(2) Date: May 20, 2019

(87) PCT Pub. No.: WO2018/092958
PCT Pub. Date: May 24, 2018

(65) Prior Publication Data

US 2019/0315006 A1 Oct. 17, 2019

(30) Foreign Application Priority Data

Nov. 21, 2016 (KR) ..... 10-2016-0154730

(51) Int. Cl.
*B26B 19/12* (2006.01)
*B26B 21/22* (2006.01)
(Continued)

(52) U.S. Cl.
CPC ..... *B26B 19/12* (2013.01); *B26B 21/222* (2013.01); *B26B 21/4012* (2013.01); *B26B 21/4062* (2013.01); *B26B 21/521* (2013.01)

(58) Field of Classification Search
CPC ... B26B 19/12; B26B 21/222; B26B 21/4012; B26B 21/4062; B26B 21/521; B26B 21/4018; B26B 21/38
See application file for complete search history.

(56) References Cited

U.S. PATENT DOCUMENTS 4,970,784 A * 11/1990 Althaus ..... B26B 21/225 30/50
5,687,485 A 11/1997 Shurtleff et al.
(Continued)

FOREIGN PATENT DOCUMENTS

CN 1890066 1/2007
GB 2419103 4/2016
(Continued)

OTHER PUBLICATIONS

State Intellectual Property Office of the People's Republic of China Application Serial No. 201680090787.2, Office Action dated Jun. 3, 2020, 6 pages.
(Continued)

*Primary Examiner* — Jonathan G Riley
(74) *Attorney, Agent, or Firm* — Lee, Hong, Degerman, Kang & Waimey PC

(57) ABSTRACT

A razor is provided, including a handle to be gripped by a user, a power generation unit disposed in the handle and configured to provide rotational power, a drive transmission unit coupled to the power generation unit and configured to be rotated by the rotational power, a cartridge including a blade housing on which one or more blades are seated, and a drive receiving unit formed at one side of the cartridge and configured to be in contact with the drive transmission unit to cause the blade housing to perform a linear movement in response to rotation of the drive transmission unit, wherein the cartridge is coupled to the handle such that the cartridge is pivotable about a pivot axis perpendicular to a rotational axis of the power generation unit, and wherein the pivot axis intersects the drive transmission unit.

15 Claims, 28 Drawing Sheets

(51) Int. Cl.
*B26B 21/40* (2006.01)
*B26B 21/52* (2006.01)

(56) References Cited

U.S. PATENT DOCUMENTS

| | | | | |
|---|---|---|---|---|
| 5,761,814 | A | 6/1998 | Anderson et al. | |
| 5,956,848 | A | 9/1999 | Tseng et al. | |
| 5,956,851 | A | 9/1999 | Apprille et al. | |
| 6,041,926 | A | 3/2000 | Petricca et al. | |
| 6,052,903 | A | 4/2000 | Metcalf et al. | |
| 6,185,822 | B1 | 2/2001 | Tseng et al. | |
| 6,212,777 | B1 | 4/2001 | Gilder et al. | |
| 6,442,839 | B1 | 9/2002 | Tseng et al. | |
| 6,516,518 | B1 | 2/2003 | Garraway et al. | |
| 6,612,040 | B2 * | 9/2003 | Gilder | B26B 21/225 30/530 |
| 6,684,513 | B1 | 2/2004 | Clipstone et al. | |
| 7,797,834 | B2 * | 9/2010 | Steunenberg | B26B 21/38 30/50 |
| 9,707,688 | B2 | 7/2017 | Giannopoulos et al. | |
| 2007/0151106 | A1 * | 7/2007 | Steunenberg | B26B 21/38 30/50 |
| 2008/0098603 | A1 | 5/2008 | Noble et al. | |
| 2008/0155831 | A1 | 7/2008 | Royle | |
| 2009/0000125 | A1 | 1/2009 | Peyser et al. | |
| 2009/0056142 | A1 | 3/2009 | Royle et al. | |
| 2010/0281694 | A1 | 11/2010 | Royle | |
| 2013/0160296 | A1 * | 6/2013 | Park | B26B 21/52 30/34.05 |
| 2016/0075040 | A1 * | 3/2016 | Nordstrom | B26B 21/18 30/71 |
| 2016/0089800 | A1 * | 3/2016 | Coresh | B26B 21/38 30/45 |
| 2018/0304483 | A1 * | 10/2018 | Lev | B26B 21/522 |

FOREIGN PATENT DOCUMENTS

| | | |
|---|---|---|
| JP | H0719420 | 5/1995 |
| JP | 2000300869 | 10/2000 |
| JP | 2007512891 | 5/2007 |
| JP | 2007222531 | 9/2007 |
| JP | 2008515501 | 5/2008 |
| JP | 2008536553 | 9/2008 |
| JP | 2010532221 | 10/2010 |
| JP | 4796068 | 10/2011 |
| KR | 101068271 | 9/2011 |
| KR | 1020150095935 | 8/2015 |
| WO | 2005053917 | 6/2005 |

OTHER PUBLICATIONS

PCT International Application No. PCT/KR2016/013432, International Search Report dated Apr. 25, 2017, 4 pages.
European Patent Office Application Serial No. 16921564.7, Search Report dated Nov. 21, 2019, 7 pages.
Japan Patent Office Application No. 2019-526242, Office Action dated Dec. 22, 2020, 4 pages.

* cited by examiner

SHAVER

CROSS-REFERENCE TO RELATED APPLICATIONS

This application is the National Stage filing under 35 U.S.C. 371 of International Application No. PCT/KR2016/013432, filed on Nov. 21, 2016, which claims the benefit of earlier filing date and right of priority to Korean Application No. 10-2016-0154730, filed on Nov. 21, 2016, the contents of which are all hereby incorporated by reference herein in their entirety.

TECHNICAL FIELD

The present disclosure relates to a razor including a blade housing with blades for body/facial hair cutting installed in such a way to allow an automatic linear movement in the direction of the body/facial hairs being cut, thereby increasing the cutting efficiency, and to allow pivoting of the cartridge, thereby enhancing the user's shaving comfort.

BACKGROUND

A razor generally includes a handle that can be grasped by the user, and a cartridge capable of cutting the body hair.

Related art includes a razor capable of providing a vibration force to the razor cartridge in the upward and downward for providing compression/distension motion for cutting the body/facial hairs. However, the prior art lacks razor configurations which provide pivoting of the cartridge or linear movement in the direction of the body/facial hairs being cut, and thus have reduced cutting efficiency and provide reduced shaving comfort. The problems of the related art are not limited to those mentioned above, and other unmentioned problems can be clearly understood by those skilled in the art.

The present disclosure seeks to provide a razor, in particular, a razor including therein a blade housing with blades for body/facial hair cutting installed in such a way to allow an automatic linear movement in the direction of the body/facial hairs being cut, thereby increasing the cutting efficiency, and to allow pivoting of the cartridge, thereby enhancing the user's shaving comfort.

SUMMARY

According to at least one embodiment of the present disclosure, a razor includes a handle configured to be gripped by a user, a power generation unit disposed in the handle and configured to provide rotational power, a drive transmission unit coupled to the power generation unit and configured to be rotated by the rotational power, a cartridge including a blade housing on which one or more blades are seated, and a drive receiving unit formed at one side of the cartridge and configured to be in contact with the drive transmission unit to cause the blade housing to perform a linear movement in response to rotation of the drive transmission unit, wherein the cartridge is coupled to the handle such that the cartridge is pivotable about a pivot axis perpendicular to a rotational axis of the power generation unit, and wherein the pivot axis intersects the drive transmission unit.

The cartridge may further include a guide member configured to guide the linear movement of the blade housing.

In addition, the razor may further include a rail at each side of the guide member, and a slider bar at each corresponding side of the blade housing, wherein the guide member guides the linear movement of the blade housing as the slide bars move along the rails.

One end of each slide bar may have a chamfer shape for reducing an area of contact with a corresponding rail.

The drive transmission unit may include an eccentric cam head having at least a partially curved surface.

The cartridge may further include a cartridge connector configured to couple the guide member to the handle and to provide the pivot axis for the cartridge to pivot.

The cartridge connector may further include a restoration unit configured to restore the cartridge to an initial state when the cartridge is pivoted about the pivot axis.

The restoration unit has elasticity, and it may be in contact with the rear of the guide member.

The cartridge connector may include a boss protruding outwardly from each side thereof, and the guide member may include boss grooves each configured to engage a corresponding boss of the cartridge connector.

Further, the pivot axis is aligned with the bosses engaged with the boss grooves.

The drive receiving unit may include an upper receiving section and a lower receiving section which protrude toward the rear of the blade housing wherein the upper receiving section and the lower receiving section are parallel and spaced apart by a predetermined distance.

The upper receiving section and the lower receiving section define a space therebetween in which the drive transmission unit is inserted.

The drive transmission unit is configured to rotate and push up the upper receiving section or push down the lower receiving section to allow the blade housing to carry out the linear movement.

The cartridge is configured to have, in an initial state, an angle generated by a skin-contact surface of the cartridge and the rotational axis is in a range of about 30° to 60°.

According to at least one embodiment of the present disclosure, a razor includes a handle, a power generation unit disposed in the handle, a cartridge including a blade housing on which one or more blades are seated, a drive receiving unit formed at one side of the cartridge, and a drive transmission unit configured to transmit power generated by the power generation unit to the drive receiving unit, causing the drive receiving unit to move such that the blade housing performs a linear movement, wherein the cartridge is pivotably coupled to the handle about a pivot axis parallel to a longitudinal direction of the one or more blades, and wherein the pivot axis intersects the drive transmission unit.

Other specific details of the present disclosure are included in the detailed description and drawings.

Advantageous Effects

The embodiments of the present disclosure have the following effects.

A blade housing with blades installed for cutting the body/facial hair performs an automatic linear movement in the direction of the body/facial hair being cut. Thus, the speed at which the blade housing performs the automatic linear movement is added to the speed at which the user carries out the manual body/facial hair cutting operation, allowing the body/facial hair cutting operation to be shortened, thereby increasing the body/facial hair cutting efficiency.

In the razor of embodiments, the cartridge, which is capable of being pivoted when the user performs the body/ facial hair cutting operation, follows along the skin-contact face in a natural pivoting movement, enhancing the user's shaving comfort.

The effects according to the present disclosure are not limited by the contents exemplified above, and more various effects are included in the specification.

DETAILED DESCRIPTION

Figure 1:
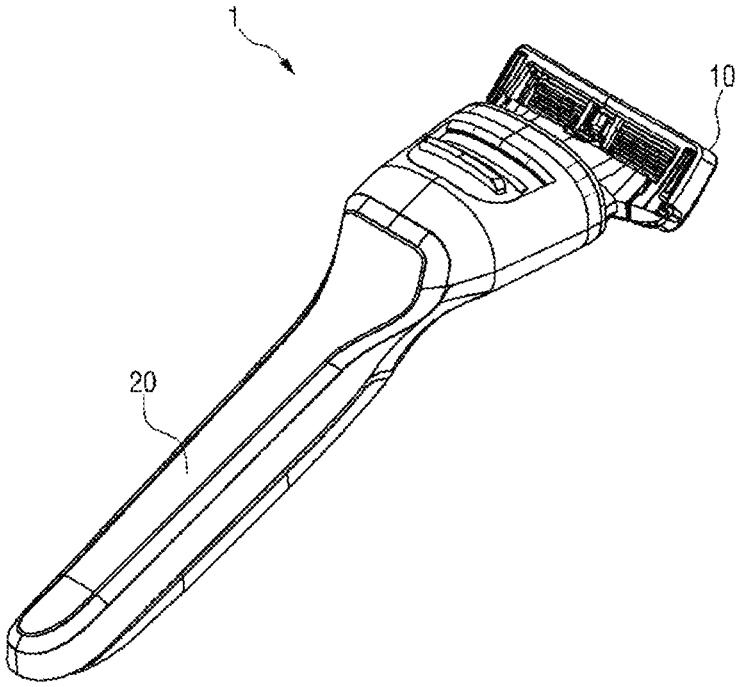
FIG. 1 is a perspective view of a razor according to at least one embodiment of the present disclosure.

The advantages and features of the present disclosure and the manner of achieving them will become apparent with reference to the embodiments described in detail below with reference to the accompanying drawings. The present disclosure may, however, be embodied in many different forms and should not be construed as limited to the embodiments set forth herein. Rather, these embodiments are provided so that this disclosure will be thorough and complete, and to fully disclose the scope of the disclosure to those skilled in the art. The disclosure is only defined by the scope of the claims. Like reference numerals designate like elements throughout the specification.

Unless defined otherwise, all terms (including technical and scientific terms) used herein may be used in a sense commonly understood by one of ordinary skill in the art to which this disclosure belongs. In addition, commonly used dictionary defined terms are not ideally or excessively interpreted unless explicitly defined otherwise.

The terminology used herein is for the purpose of illustrating embodiments and is not intended to be limiting of the present disclosure. In the present specification, a singular form of nouns includes their plural forms unless otherwise specified in the specification. Throughout this specification, when a part "comprises" and/or is "comprising" an element, present disclosure does not exclude the presence or addition of one or more other elements in addition to the stated element.

Hereinafter, some embodiments of the present disclosure will be described in detail with reference to the accompanying drawings.

FIG. 1 is a perspective view of a razor 1 according to at least one embodiment of the present disclosure.

As shown in FIG. 1, the razor 1 according to at least one embodiment includes a handle 20 coupled to a cartridge 10 having a plurality of blades 111 for cutting body/facial hairs.

The handle 20 is a portion to be gripped by a user. The user can cut the body/facial hairs by hand-holding the handle 20, bringing one side of the cartridge 10 into contact with the part where the body/facial hairs are to be cut, and then applying a wrist snapping action or changing the grip of the handle 20. Generally, the razor 1 is used for cutting a male's beard while washing the face, and for cutting a leg hair or the like for a female. Cutting the hairs is often done in a washroom, and thus, it is common that the handle 20 is grasped by the user's wet hand, or the moisture level in the washroom is very high. Therefore, it is preferable that the handle 20 is made of a grippy material comfortable for the user, for example, synthetic rubber, plastic or the like, which does not readily corrode even if it is frequently in contact with moisture. However, the handle 20 is not limited thereto, and can be made of various other materials.

The cartridge 10 includes a blade housing 11 and a guide member 12. The cartridge 10 and the handle 20 are connected via a cartridge connector 40.

The handle 20 is mounted internally with a power unit 30. The power unit 30 contacts the blade housing 11 of the cartridge 10 and generates power to cause the blade housing 11 to move linearly. Details of the cartridge 10 and the power unit 30 will be described later.

Figure 2:
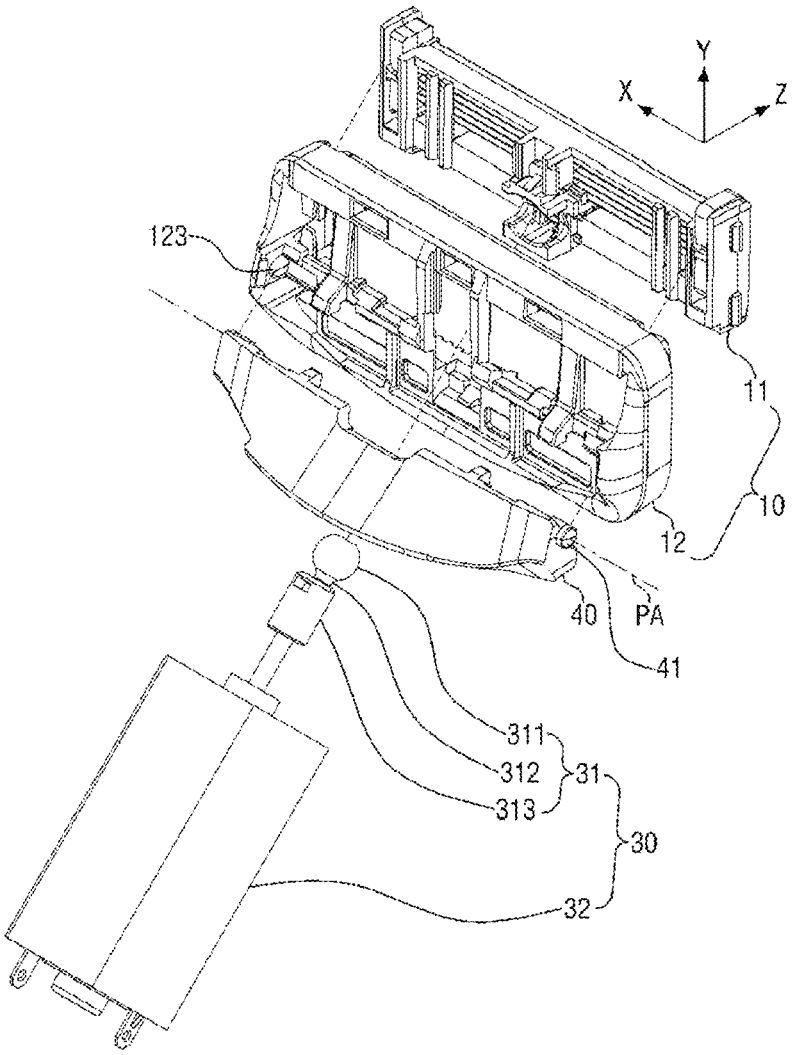
FIG. 2 is an exploded perspective view of a cartridge and a power unit (30) according to at least one embodiment of the present disclosure.

FIG. 2 is an exploded perspective view of a cartridge 10 and a power unit 30 according to at least one embodiment of the present disclosure.

As shown in FIG. 2, the cartridge 10 is in contact with the power unit 30. As described above, the cartridge 10 includes the blade housing 11 and the guide member 12. The blade housing 11 is installed with a plurality of blades 111 for cutting the body/facial hairs, and is linearly moved by receiving power. The guide member 12, which houses blade housing 11 and frame 112 as shown in FIG. 2 and the various figures, guides the blade housing 11 so as to smoothly perform a linear movement.

The cartridge connector 40 connects the guide member 12 and the handle 20, and provides a pivot axis PA for the cartridge 10 to pivot. Hereinafter, FIG. 3 to FIG. 6 will be described with reference to FIG. 2.

Figure 3:
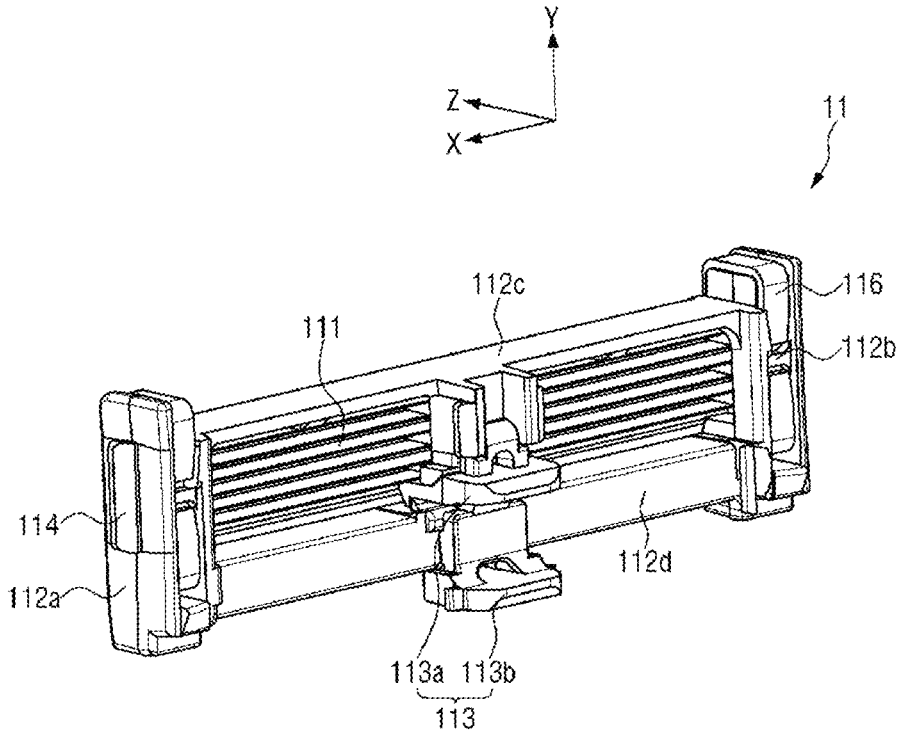
FIG. 3 is a rear perspective view of a blade housing according to at least one embodiment of the present disclosure.

FIG. 3 is a rear perspective view of a blade housing 11 according to at least one embodiment of the present disclosure.

As shown in FIG. 2 and FIG. 3, the blade housing 11 includes a plurality of blades 111 for cutting the body/facial hairs, and a frame 112 for supporting the plurality of blades 111.

The frame 112 has a substantially rectangular structure opening to the front and to the rear. A vertical up and down direction of the cartridge 10 refers to the longitudinal direction of frame sides 112*a* and 112*b* extending a shorter length of the cartridge 10, and a lateral direction of the cartridge 10 refers to the longitudinal direction of the long frame sides 112*c* and 112*d* extending a greater length of the cartridge 10. The longitudinal direction means the direction of the longest element among the height, length, and width. When the frame sides are connected to each other, a substantially rectangular face is formed having edges of the frame 112. The front-rear direction of the cartridge 10 refers to a normal direction perpendicular to the rectangularly formed face.

As shown in FIG. 2, the left-right axis of the cartridge 10 are defined as an X axis, the vertical axis as a Y axis, and the front-rear axis as a Z axis. The left direction is defined as the X-axis direction, the right direction as the negative X-axis direction, the upward direction as the Y-axis direction, the downward direction as the negative Y-axis direction, the front direction as the Z-axis direction, and the rear direction as the negative Z-axis direction. Here, the X, Y, and Z axes take the cartridge 10, not an eccentric cam 31, as a reference. In describing directions of the eccentric cam 31, the reference is based on the direction shown in the drawing.

In the present specification, the X, Y, and Z axes are defined as above, and the present disclosure will be described below with reference to the X, Y, and Z axes defined above. However, the X, Y, and Z axes defined above are merely for convenience of description of the present disclosure, and do not limit the scope of the present disclosure.

Specifically, the frame 112 has the first frame side 112*a* and the second frame side 112*b*, each of which is relatively short in length, and which are formed on the right and left sides, respectively. The frame 112 also has a lower frame side 112*d* which is relatively long and connects the first frame side 112*a* and the second frame side 112*b* at their lower ends, and an upper frame side 112*c* which is relatively long and connects the first frame side 112*a* and the second frame side 112*b* at their upper ends.

The plurality of blades 111 is installed so that each blade 111 has its edge exposed on the front surface of the frame 112 with both ends thereof being supported by the first frame side 112*a* and the second frame side 112*b*. As shown in FIGS. 2 and 3, the plurality of blades 111 may be fixed to the first frame side 112*a* and the second frame side 112*b* by clips 116 formed to penetrate or envelope the first frame side 112*a* and the second frame side 112*b*, or penetrate one of the first frame side 112*a* and the second frame side 112*b* and envelope the other. In addition, other types of fastening devices than the clip 116 may be used to fasten the plurality of blades 111. The blades 111 may be disposed parallel to each other and parallel to the upper frame side 112*c* and the lower frame side 112*d*. The edges of the plurality of blades 111 are bent at a predetermined angle with respect to the forward direction, i.e., the Z-axis direction of the blade housing 11. Particularly, the edge is advantageously bent downward with respect to the forward direction of the blade housing 11, i.e., toward the negative Y-axis direction so as to facilitate cutting of the body/facial hairs. However, the present disclosure is not limited to this, and the blade 111 may be a steel strip blade or a flat blade. Here, the steel strip blade is a kind of the blade 111 provided with a blade member welded to the upper surface of a bent support body. The flat blade is a unitary type of the blade 111 formed to be flat without being bent or curved.

On the rear surface of the blade housing 11, a drive receiving unit capable of contacting the power unit 30 is formed. In this embodiment, an eccentric cam receptacle 113 is used as an example of the drive receiving unit. The eccentric cam receptacle 113 includes an upper receiving section 113*a* and a lower receiving section 113*b*. As shown in FIGS. 2 and 3, the upper receiving section 113*a* and the lower receiving section 113*b* of the eccentric cam receptacle 113 are attached to substantially the center of the lower frame side 112*d* of the blade housing 11, protruding rearward of the blade housing 11, i.e., in the negative Z-axis direction. The upper receiving section 113*a* and the lower receiving section 113*b* are formed to be spaced apart from each other by a predetermined distance and are formed to be parallel to the upper frame side 112*c* and the lower frame side 112*d*. Therefore, the upper receiving section 113*a*, the lower frame side 112*d* of the blade housing 11, and the lower receiving section 113*b* have a substantially '⊏' symbol shape. The upper receiving section 113*a* and the lower receiving section 113*b* may have a substantially rectangular shape, but are not limited thereto and may have various shapes. Power is transmitted to the eccentric cam receptacle 113 according to the operation of the power unit 30, so that the blade housing 11 moves linearly, and a detailed description thereof will be provided below.

Figure 4:
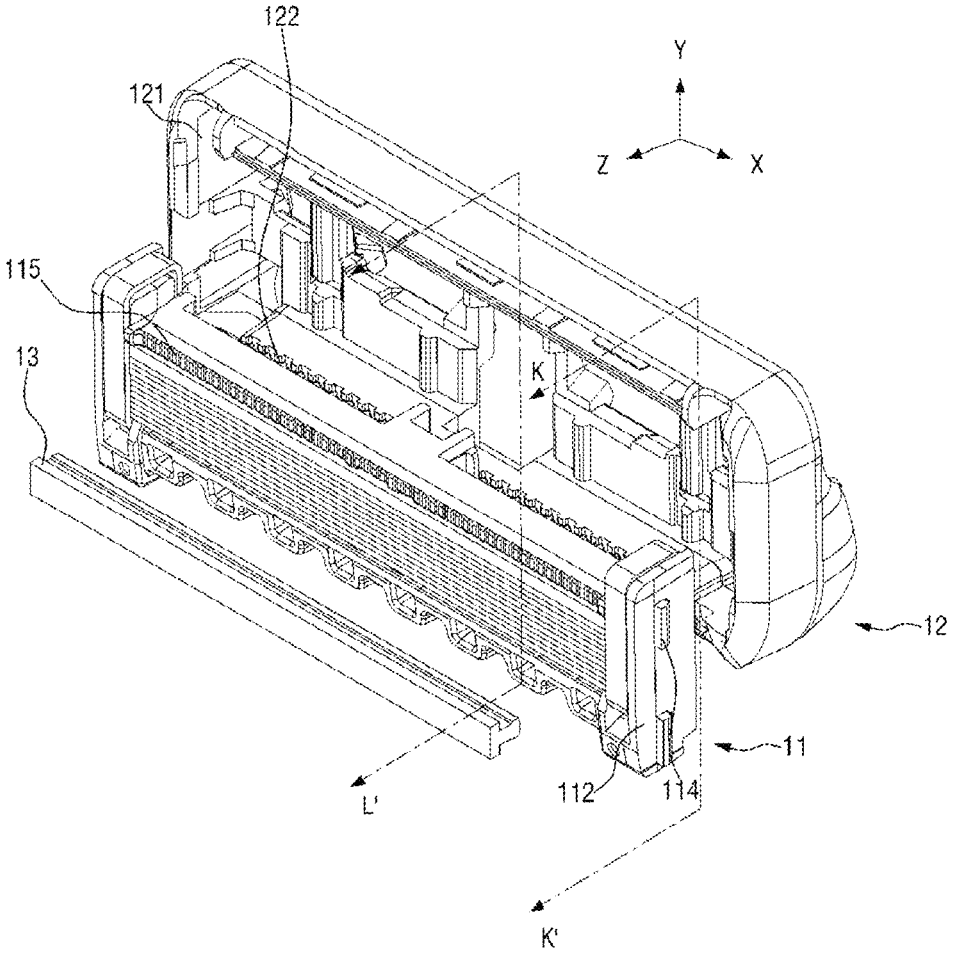
FIG. 4 is an exploded perspective view of a blade housing and a guide member according to at least one embodiment of the present disclosure.
Figure 5:
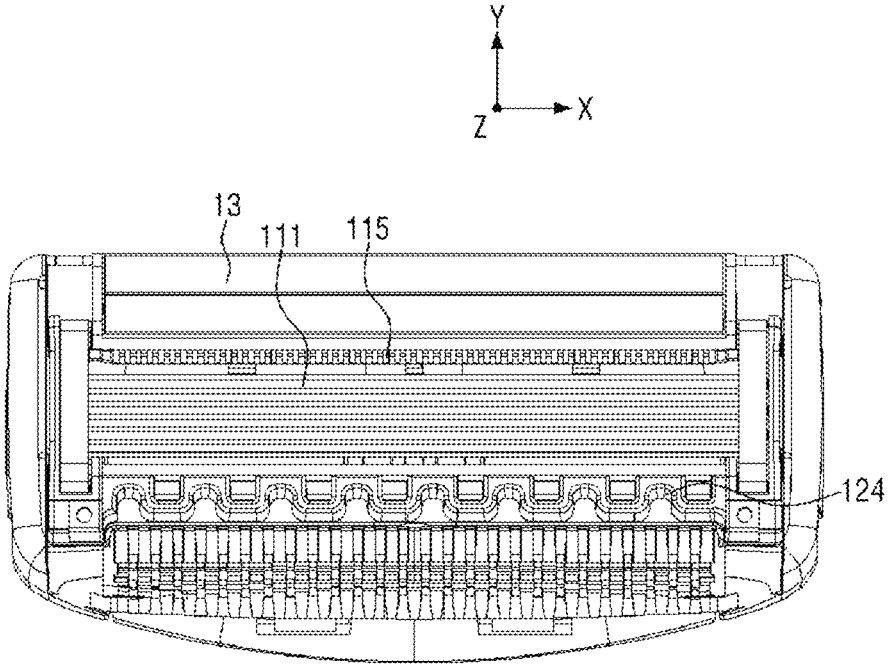
FIG. 5 is a front view of a cartridge according to at least one embodiment of the present disclosure.

Protruding from both outer side surfaces of the first and second frame sides 112*a* and 112*b* of the blade housing 11 are slide bars 114 formed to be guided by the guide member 12. According to at least one embodiment of the present disclosure, the slide bars 114 are linearly elongated in the Y-axis direction and the negative Y-axis direction. However, when the blade housing 11 is configured to move in a different direction, the slide bars 114 may be made to extend along a straight line in another direction. Further, when the blade housing 11 is configured to have a curvilinear motion rather than a linear motion, the slide bar 114 may be formed corresponding to the curvilinear motion of the blade housing 11, and in other various ways, it may be modified adaptively. The slide bar 114 may be formed on each of the outer side surfaces of the first and second frame sides 112*a* and 112*b*, or one or more of the slide bar 114 may be formed on each of the outer side surfaces of the first and second frame sides 112*a* and 112*b*. Alternatively, the number of the slide bars 114 formed in the first frame side 112*a* may be different from that of the slide bars 114 formed in the second frame side 112*b*. FIG. 4 is an exploded perspective view of the blade housing 11 and the guide member 12 according to at least one embodiment, and FIG. 5 is a front view of the cartridge 10 according to at least one embodiment of the present disclosure.

The guide member 12 guides the blade housing 11 to facilitate the linear movement. On each of inner side surfaces of the guide member 12, a rail 121 is formed so as to be able to engage with a corresponding slide bar 114 formed on a corresponding one of outer side surfaces of the blade housing 11. The rail 121 is formed in a straight line extending in the Y-axis direction and the negative Y-axis direction to correspond to the slide bar 114. The slide bar 114 has a generally rectangular parallelepiped shape elongated in the Y-axis direction. In some embodiments, the slide bar 114 may be chamfered at one end to have an acute angle or a curved surface in order to facilitate the engagement with the rail 121, and after the engagement, to reduce the contact area between the slide bar 114 and the rail 121 in order to reduce frictional force therebetween. Then, the slide bar 114 is slidingly engaged with the rail 121 so that the blade housing 11 is linearly reciprocated with respect to the guide member 12 in the Y-axis direction and the negative Y-axis direction in which the rails 121 are formed.

According to at least one embodiment of the present disclosure, the rails 121 extend along a straight line in the Y-axis direction and the negative Y-axis direction, but the present disclosure is not limited thereto. Depending on the configured direction of movement of the blade housing 11, the rails 121 may be formed in a straight line in another direction. Further, when the blade housing 11 is configured to perform a curved movement, rather than a linear movement, the rails 121 may be formed to correspond to the curved movement of the blade housing 11, and in other various ways, they may be modified adaptively. The rails 121 may be modified as long as they have an engaging formation with the slide bar 114 by conforming the rails 121 to the width and the orientation of the slide bar 114. In other words, the manner in which the blade housing 11 moves depends on the orientation of the formation of the slide bar 114 and the rail 121. However, at least one embodiment of the present disclosure, as described above, prefers that the blade housing 11 linearly reciprocates in the Y-axis direction and the negative Y-axis direction, and hereinafter, the slide bar 114 and the rails 121 will be described as being elongated in the Y-axis direction and in the negative Y-axis direction.

As shown in FIGS. 2 and 4, the slide bars 114 are shaped to protrude outward from both outer side surfaces of the blade housing 11, and the rails 121 are recessed inwardly at both inner side surfaces of the guide member 12. When the slide bar 114 and the rail 121, which have corresponding widths therebetween, are coupled together, the blade housing 11 is fixed with respect to the X-axis direction of the guide member 12, and is allowed to reciprocate exclusively in the Y-axis direction of the guide member 12, although the present disclosure is not limited thereto. For example, the slide bars 114 may be formed on both inner side surfaces of the guide member 12, and the rails 121 may be formed on both outer side surfaces of the blade housing 11, or the slide bars 114 and the rails 121 may be formed at various other positions.

The front side of the guide member 12 is open to facilitate engagement with the blade housing 11. Once the blade housing 11 and the guide member 12 are engaged, the blade housing 11 is accommodated in the inner space of the guide member 12, as shown in FIG. 5. The guide member 12 has a rubber guard 122 protruding from its lower portion toward the Z-axis direction, so that when the blade housing 11 is positioned at the lowermost position in the negative Y-axis direction with respect to the guide member 12, the lower frame side 112*d* of the blade housing 11 is positioned closest to the rubber guard 122. At this time, at the front surface of the cartridge 10, there should be no or very minute step formed between the blade housing 11 and the guide member 12. If a minute step is formed, it may be due to inadvertent occurrence during the manufacturing process or may be intentionally induced for user's convenience.

Therefore, the length, height, and width of the inner space of the guide member 12 accommodating the blade housing 11 may be formed to respectively correspond to the length, height, and width of the blade housing 11. The length and width of the inner space of the guide member 12 may be less than the length and width of the blade housing 11 by an offset amount so that the blade housing 11 can smoothly slide relative to the guide member 12. Further, as shown in FIG. 5, it is preferable that the height of the inner space of the guide member 12 be twice the amplitude of the blade housing 11 when the blade housing 11 performs the sliding reciprocating movement in the Y-axis direction.

As shown in FIG. 5, the blade housing 11 may be provided on its front surface with a comb guard 115, and provided on the lower portion of the guide member 12 with the rubber guard 122.

The comb guard 115 is disposed above the blades 111, as shown in FIG. 5, to assist lubricant application by a lubrication band 13. In some embodiment, the comb guard 115 is disposed below the blades 111, which can align the body/facial hairs that enter the plurality of blades 111. In other words, the comb guard 115 is not confined to a specific position, but may be disposed at various positions according to the functions to be performed.

The rubber guard 122 pulls the skin in contact with the cartridge 10 to guide the plurality of blades 111 to effectively cut the body/facial hairs.

The lubrication band 13 expands upon contact with water and provides a water-soluble material including a lubricating component, a soothing component, and the like. This supplies a lubricating component and a soothing component to the skin contacting the cartridge 10 during the shaving process, allowing the cartridge 10 to proceed smoothly while in contact with the skin surface and to sooth the skin.

As shown in FIG. 5, an opening 124 may be formed between the blades 111 and the rubber guard 122 on the guide member 12. The opening 124 enhances the shaving performance by causing a part of the skin to convex, thus inducing the body/facial hairs to be cut in upright posture.

Heretofore, the comb guard 115 is provided in the blade housing 11 and the rubber guard 122 is provided in the guide member 12 as described referring to FIG. 5. The lubrication band 13 is not specified positionally between the blade housing 11 and the guide member 12. However, the present disclosure is not limited to the above description, but may encompass different configurations. The comb guard 115 may be provided on the upper side, the lower side, or both the upper and lower sides of the guide member 12. The rubber guard 122 may be provided on the blade housing 11. The lubrication band 13 may be provided on the upper side, the lower side, or both the upper and lower sides of the blade housing 11 or of the guide member 12.

Figure 6:
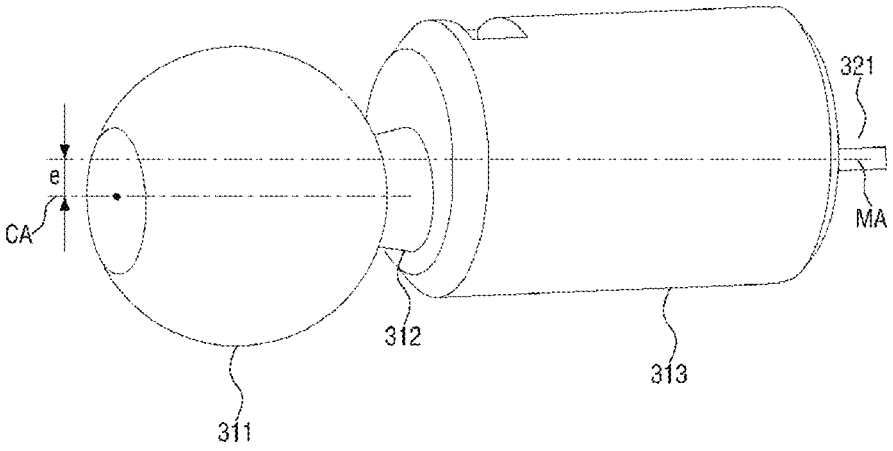
FIG. 6 is a side perspective view of an eccentric cam according to at least one embodiment of the present disclosure.

FIG. 6 is a side perspective view of an eccentric cam 31 according to at least one embodiment.

As described above, a power unit 30 is mounted within the handle 20. The power unit 30 contacts the blade housing 11 and generates power to cause the blade housing 11 to perform a linear movement. As shown in FIG. 2, the power unit 30 includes a power generator that receives electric power from an external source and generates a rotational power. This embodiment utilizes the motor 32 as one of various forms of the power generator. However, the power generator may include various devices capable of generating repetitive motions such as solenoids that perform linear motion in addition to the motor 32 that performs rotational motions.

The power unit 30 further includes a drive transmission unit for transmitting the power received from the motor 32. In this embodiment, the eccentric cam 31 is used as an example of the drive transmission unit. Therefore, in the present embodiment, the power unit 30 also includes the eccentric cam 31 which is rotated by the power received from the motor 32, and whose rotational axis MA is eccentrically formed. The drive transmission unit transmits the power generated by the rotational or linear motion transmitted from the power generator to a drive receiving unit to be described later so that the drive receiving unit can perform a linear motion. The eccentric cam 31 is merely an example in the present disclosure, and other configurations may be possible as long as they serve the same purpose of the eccentric cam 31.

The eccentric cam 31 includes an eccentric cam head 311, an eccentric cam body 313 and an eccentric cam neck 312. The eccentric cam head 311 is directly engaged with the blade housing 11 to linearly move the same. The eccentric cam body 313 rotates the eccentric cam head 311 with the drive received from the motor 32, and renders rotational axis MA of the eccentric cam head 311 to be eccentric. The eccentric cam neck 312 interconnects the eccentric cam head 311 and the eccentric cam body 313. The motor 32, eccentric cam body 313, eccentric cam neck 312 and eccentric cam head 311 are sequentially connected to allow the rotation of the motor 32 by its shaft 321 to rotate the eccentric cam body 313 in unison with the eccentric cam neck 312 and the eccentric cam head 311 about the rotational axis MA of the shaft 321.

The motor 32 is supplied with external power, and rotates the shaft 321 of the motor 32. For the motor 32 to easily receive external power, the handle 20 may further include a battery (not shown). The battery may include various kinds of battery such as nickel-cadmium (Ni—Cd), nickel-hydride (Ni-MH), lithium-ion (Li-ion), or lithium polymer battery (not shown). Rotational axis MA advantageously coincides with the central axis of the shaft 321 of the motor 32. Since the eccentric cam 31 is rotated by the motor 32, the eccentric cam body 313, eccentric cam neck 312 and eccentric cam head 311, all that will be described below, rotate about the rotational axis MA.

One side of the eccentric cam body 313 is connected to the shaft 321 of the motor 32, to co-rotate therewith, as shown in FIGS. 2 and 6. The central axis of the eccentric cam body 313 advantageously coincides with rotational axis MA. Therefore, the eccentric cam body 313 and the shaft 321 of the motor 32 can coaxially rotate by sharing rotational axis MA of the motor 32. The eccentric cam body 313 is preferably cylindrical in shape to facilitate rotation. However, the present disclosure is not limited thereto, and the eccentric cam body 313 may have various shapes such as a polygonal column, a sphere, and the like.

The eccentric cam body 313 has its other side connected with one side of the eccentric cam neck 312 so that the eccentric cam neck 312 co-rotates with the eccentric cam body 313. At this time, the eccentric cam neck 312 is eccentrically connected to the eccentric cam body 313 so that the central axis of the eccentric cam neck 312 does not coincide with rotational axis MA. The eccentric cam neck 312 preferably has a cylindrical or truncated cone shape, but is not limited thereto and may have various shapes. When the eccentric cam neck 312 has a shape of a truncated cone having varying diameter along its height, as shown in FIG. 6, the largest diameter of the eccentric cam neck 312 is still smaller than the diameter of the eccentric cam body 313 as well as the diameter of the eccentric cam head 311. The embodiments, however, are not necessarily limited to this configuration. The diameter of the eccentric cam neck 312 may be larger than that of the eccentric cam body 313 or that of the eccentric cam head 311. Some embodiments even save the eccentric cam neck 312 by directly interconnecting the eccentric cam body 313 and the eccentric cam head 311.

The eccentric cam neck 312 has its other side connected to one side of the eccentric cam head 311 so that the eccentric cam head 311 corotates with the eccentric cam neck 312. The eccentric cam head 311 may share the central axis of the eccentric cam neck 312 coaxially, wherein the eccentric cam head 311 has its central axis CA deviating from rotational axis MA. As shown in FIGS. 2 and 6, the eccentric cam head 311 according to at least one embodiment of the present disclosure has a substantially spherical shape. This allows the eccentric cam head 311 and the eccentric cam receptacle 113 to be smoothly brought into contact with each other when the cartridge 10 is pivoted about the cartridge connector 40. Therefore, the entire eccentric cam head 311 favorably has a certain curvature.

The eccentric cam head 311 may have the shape of a sphere in a part as well as the entirety of the outer peripheral surface. Therefore, only a part of the eccentric cam head 311 may have a constant curvature. One side of the eccentric cam head 311 is connected to the eccentric cam neck 312. At this time, the one side of the eccentric cam head 311, connected to the eccentric cam neck 312, and the other opposite side of the eccentric cam head 311 may have different respective curvatures from those of the remaining portions of the eccentric cam head 311 except for the one side and the other side. In addition, the one side and the other side of the eccentric cam head 311 may even have a curvature of zero or an aspherical surface. On the other hand, the remaining portions of the eccentric cam head 311 except for the one side and the other side preferably have a constant curvature since they have a spherical shape. The remaining portion of the eccentric cam head 311 except for the one side and the other side may include a contact face CF on which an actual contact with the eccentric cam receptacle 113 may occur. This is to allow the eccentric cam head 311 and the eccentric cam receptacle 113 to be smoothly brought into contact with each other when the cartridge 10 is pivoted about the cartridge connector 40.

However, the shape of the eccentric cam receptacle 113 according to the embodiments of the present disclosure is not limited to a spherical shape, and may have a shape of a polygonal, a cylinder, or the like. Furthermore, the eccentric cam head 311 may not have the shape of a sphere, but may have a shape of an ellipsoid protruding partly, and even further, may not have a constant curvature. That is, the eccentric cam head 311 according to the embodiments of the present disclosure may have various forms without limitation as long as it can contact the eccentric cam receptacle 113 to move the blade housing 11.

In summary, the motor 32, eccentric cam body 313, eccentric cam neck 312 and eccentric cam head 311 are sequentially connected to each other, so that the shaft 321 of the motor 32 and the central axis of the eccentric cam body 313 share rotational axis MA coaxially, and central axis CA of both the eccentric cam head 312 and the eccentric cam head 311 are eccentrically connected to rotational axis MA. However, the present disclosure is not limited to this, and the central axis of the eccentric cam neck 312 may be coaxial with rotational axis MA, or the central axis of the eccentric cam body 313 may be eccentrically connected to rotational axis MA. Yet, central axis CA of the eccentric cam head 311 according to some embodiments of the present disclosure remains to be eccentrically connected to the rotational axis MA. Accordingly, central axis CA of the eccentric cam head 311 rotates or revolves about rotational axis MA, which can convert the rotational motion of the eccentric cam head 311 to the linear motion of the blade housing 11.

Central axis CA of the eccentric cam head 311 and rotational axis MA do not coincide and are parallel to each other. Thus, a certain distance (e) exists between central axis CA of the eccentric cam head 311 and rotational axis MA. Distance (e) may dictate the amplitude of the linear motion of the blade housing 11. A detailed description thereof will be provided below.

Figure 7:
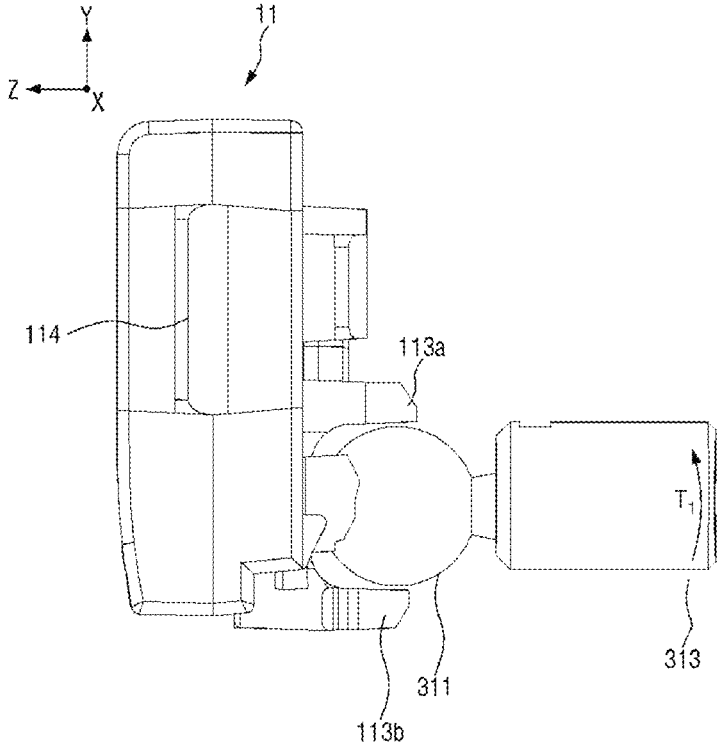
FIG. 7 is a side view of a blade housing and an eccentric cam as coupled together according to at least one embodiment of the present disclosure.

FIG. 7 is a side view of the blade housing 11 and the eccentric cam 31 as coupled together according to at least one embodiment of the present disclosure.

As described above, the blade housing 11 is formed with the eccentric cam receptacle 113 on its rear surface. Then, the upper receiving section 113*a*, the lower frame side 112*d* of the blade housing 11, and the lower receiving section 113*b* have a substantially '⊏' symbol shape. As shown in FIG. 7, the upper receiving section 113*a* and the lower receiving section 113*b* are spaced apart from each other by a certain distance. The certain distance of a space formed between the upper receiving section 113*a* and the lower receiving section 113*b* accommodates insertion of the eccentric cam head 311 of the eccentric cam 31, to transmit the drive of the power unit 30 to the cartridge 10. At this time, the certain distance in the space between the upper receiving section 113*a* and the lower receiving section 113*b* is represented by a length S which corresponds to a diameter D of the eccentric cam head 311 in some embodiments, so that the eccentric cam head 311 can easily enter the space. While the upper receiving section 113*a* and the lower receiving section 113*b* are spaced by length S which corresponds to diameter D of the eccentric cam head 311, smooth rotation of the eccentric cam head 311 takes some difference between length S and diameter D, which will be detailed below.

When the eccentric cam head 311 rotates eccentrically as the motor 32 rotates, the eccentric cam receptacle 113 in contact with the eccentric cam head 311 is subjected to the rotational force of the eccentric cam head 311. At this time, since the eccentric cam receptacle 113 is formed on the upper and lower sections of the eccentric cam head 311, the eccentric cam receptacle 113 is controlled by the upward and downward components of the rotational force of the eccentric cam head 311. However, since the eccentric cam receptacle 113 does not contact the left and right sides of the eccentric cam head 311, it is not controlled by the leftward and rightward components of the rotational force. Therefore, the eccentric cam receptacle 113 is influenced by the components of the rotational force of the eccentric cam head 311 that are directed upward and downward. This will be described in detail referring to FIGS. 8 to 10.

Figure 8:
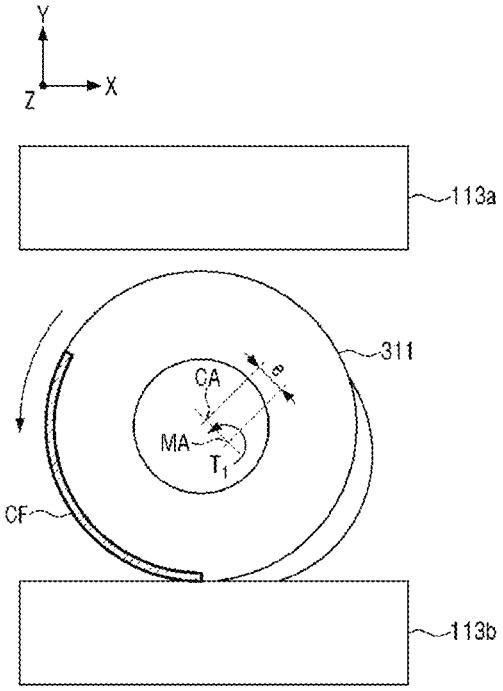
FIGS. 8 to 10 are schematic views showing the movement of an eccentric cam receptacle according to the rotational motion of an eccentric cam head according to at least one embodiment of the present disclosure.
Figure 9:
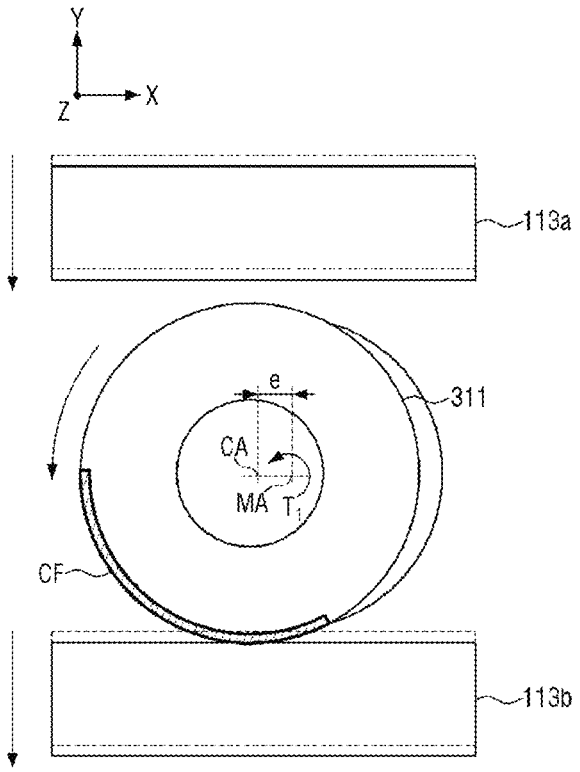
Figure 10:
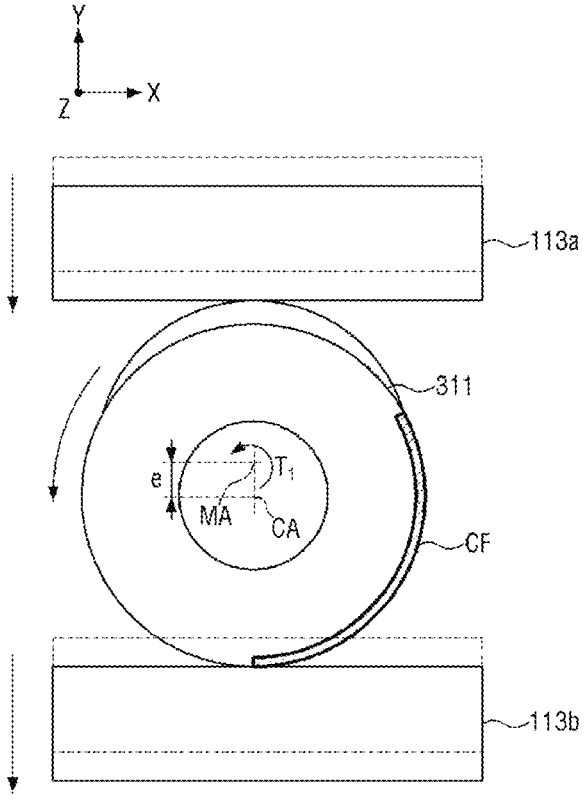
Figure 11:
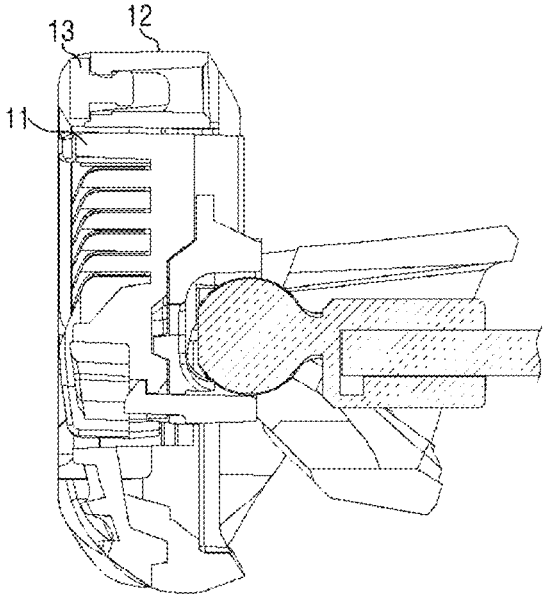
FIGS. 11 to 13 are side cross-sectional views taken along line L-L' in FIG. 4, showing the change of a cartridge according to at least one embodiment of the present disclosure, when the blade housing linearly moves with respect to a guide member according to the movement of the eccentric cam receptacle shown in FIGS. 8 to 10.
Figure 12:
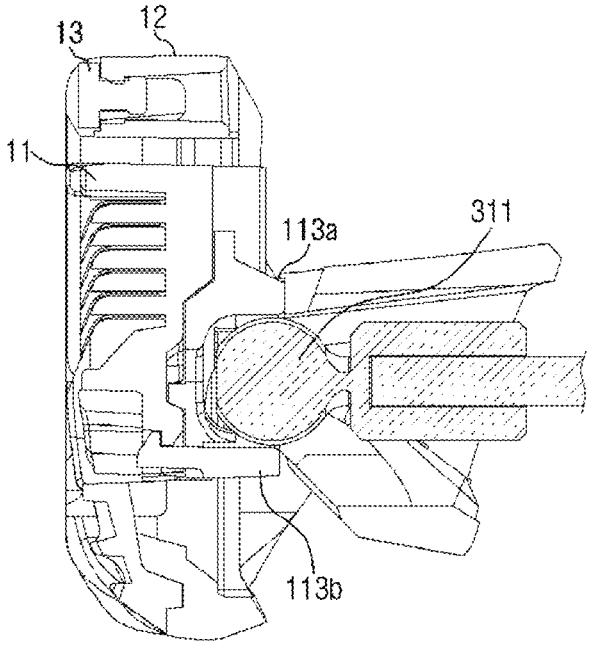
Figure 13:
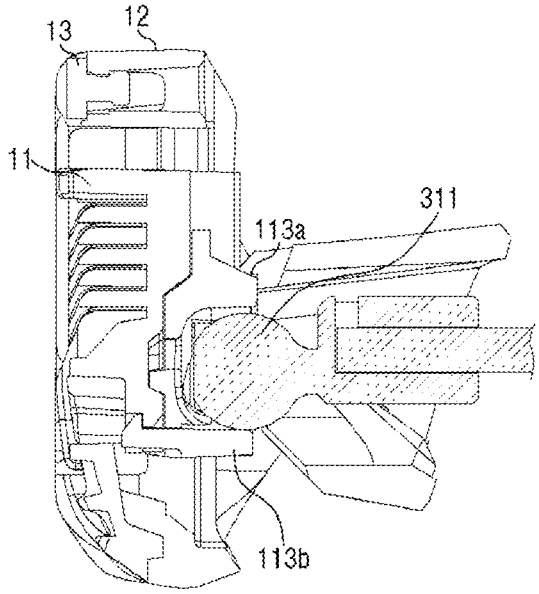

FIGS. 8 to 10 are schematic views showing the movement of the eccentric cam receptacle 113 according to the rotational motion of the eccentric cam head 311 according to at least one embodiment of the present disclosure. FIGS. 11 to 13 are side cross-sectional views taken along line L-L' in FIG. 4, showing the change of the cartridge 10 according to at least one embodiment of the present disclosure, when the blade housing 11 linearly moves with respect to the guide member 12 according to the movement of the eccentric cam receptacle 113 in FIGS. 8 to 10.

The eccentric cam head 311 is eccentrically connected to the rotational axis MA. Therefore, when the eccentric cam head 311 rotates, central axis CA of the eccentric cam head 311 rotates or revolves around rotational axis MA. As shown in FIG. 8, the eccentric cam head 311 during the rotation comes into contact with the lower receiving section 113*b*. FIG. 8 corresponds to FIG. 11. Specifically, before the eccentric cam head 311 contacts and pushes the lower receiving section 113*b* downward as shown in FIG. 8, that is, in the negative Y-axis direction, the blade housing 11 is located at the uppermost position as shown in FIG. 11. At this time, the height of the inner space of the guide member 12 according to at least one embodiment corresponds to twice the amplitude of the blade housing 11 when the blade housing 11 performs sliding reciprocating movement in the Y-axis direction.

Contact face CF of the eccentric cam head 311 is defined as the surface on which the eccentric cam head 311 comes in contact with the eccentric cam receptacle 113. When the eccentric cam receptacle 113 moves downward, that is, in the negative Y-axis direction, contact face CF of the eccentric cam head 311 contacts the lower receiving section 113*b*, and when the eccentric cam receptacle 113 moves upward in the Y-axis direction, contact face CF of the eccentric cam head 311 contacts the upper receiving section 113*a*. Contact face CF of the eccentric cam head 311 when contacting the lower receiving section 113*b* may coincide with that of the eccentric cam head 311 when contacting the upper receiving section 113*a*, which, however, may not always be the case, but is subject to change from time to time.

As shown in FIG. 9, the eccentric cam head 311 rotates and pushes the lower receiving section 113*b* gradually downward, that is, in the negative Y-axis direction, using the rotational force. As described above, the linear motion of the eccentric cam receptacle 113 is controlled by the upward and downward components of the rotational force of the eccentric cam head 311. Therefore, the force of pushing the lower receiving section 113*b* downward, that is, the negative Y-axis direction at this time, is a downward component of the rotational force of the eccentric cam head 311. At this time, FIG. 9 corresponds to FIG. 12. Specifically, when the eccentric cam head 311 pushes the lower receiving section 113*b* gradually downward as shown in FIG. 9, that is, in the negative Y-axis direction, the blade housing 11 also moves linearly downward with respect to the guide member 12, that is, in the negative Y-axis direction, as shown in FIG. 12.

As shown in FIG. 10, when the eccentric cam head 311 is positioned near the lowermost end, the lower receiving section 113*b* is positioned at the lowermost position. FIG. 10 corresponds to the case of FIG. 13. Specifically, when the lower receiving section 113*b* is positioned near the lowermost end as shown in FIG. 10, the blade housing 11 is also positioned at the lowermost position with respect to the guide member 12, as shown in FIG. 13. At this time, the lower frame side 112*d* of the blade housing 11 is positioned close to the rubber guard 122 of the guide member 12, as described above referring to FIG. 5. In some embodiments, little to no step is formed between the blade housing 11 and the guide member 12 at the front surface of the cartridge 10. Any step or difference in leveling may be due to tolerances during the manufacturing process or may be intentionally induced for user's convenience.

After this moment, continued rotation of the eccentric cam head 311 disengages contact face CF of the eccentric cam head 311 from the lower receiving section 113*b*, and further rotation thereof brings contact face CF of the eccentric cam head 311 into contact with the upper receiving section 113*a*. Then, the process described above referring to FIGS. 8 to 10 is repeated with respect to the upper receiving section 113*a* instead of the lower receiving section 113*b*. Specifically, when the eccentric cam head 311 pushes the upper receiving section 113*a* upward gradually, that is, in the Y-axis direction by using the rotational force, the upper receiving section 113*a* moves upward. At this time, the blade housing 11 also slides relative to the guide member 12 and linearly moves upwardly, that is, in the Y-axis direction, and the cartridge 10 changes in the reverse order from that described referring to FIGS. 11 to 13.

On the other hand, as shown in FIGS. 8 to 10, distance (e) is constant between rotational axis MA and central axis CA of the eccentric cam head 311. This is because the eccentric cam head 311 is eccentrically connected to rotational axis MA. Distance (e) between rotational axis MA and central axis CA of the eccentric cam head 311 is an eccentricity of the eccentric cam head 311, and it is associated with the amplitude of the rotational motion of the eccentric cam head 311. This will be described in detail below.

Among the upper, lower, left, right, front, and back directions used for the above description, the description of the orientation of the cartridge 10 is based on the X, Y and Z axes. However, the orientation of the eccentric cam head 311 is independent of the X, Y and Z axes. This is because the X, Y and Z axes refer to the cartridge 10. Since the cartridge 10 can pivot, it may have up, down, left, right, front and rear directions different from those of the eccentric cam head 311. In describing directions of the eccentric cam 31, the reference is based on the direction shown in the drawing, as mentioned above. However, this is for convenience of description of the present disclosure, and does not limit the scope of the present disclosure.

Figure 14:
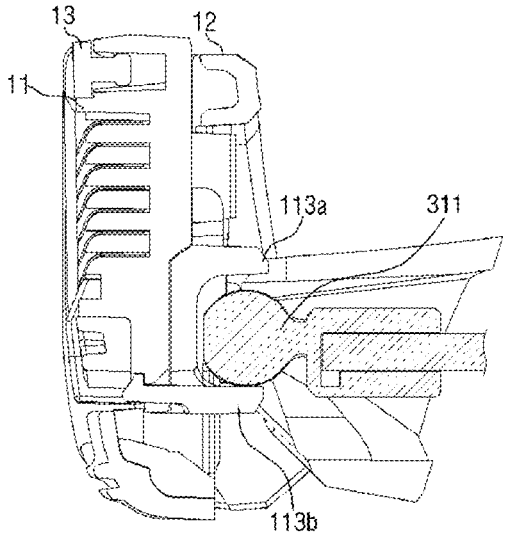
FIGS. 14 to 16 are partial side cross-sectional views of a razor, showing the change of a cartridge according to another embodiment of the present disclosure, when a blade housing linearly moves with respect to a guide member according to the movement of the eccentric cam receptacle shown in FIGS. 8 to 10.
Figure 15:
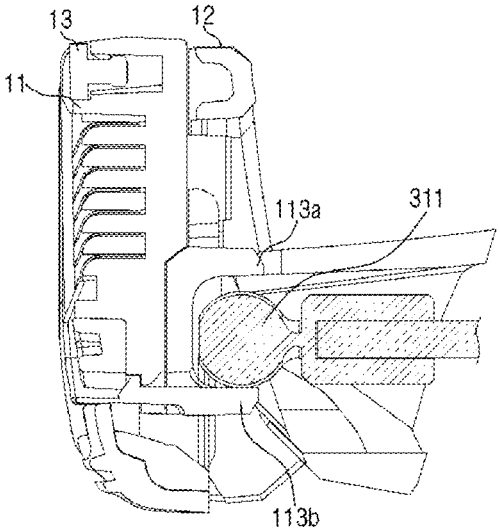
Figure 16:
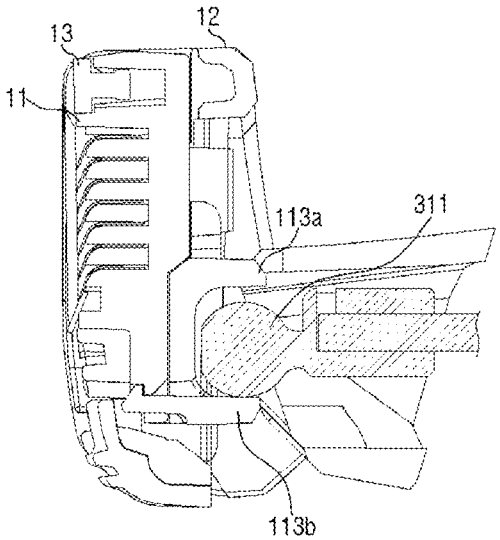

FIGS. 14 to 16 are partial side cross-sectional views of a razor, showing changes of a cartridge 10 according to another embodiment of the present disclosure, when a blade housing 11 linearly moves with respect to a guide member 12 according to the movement of the eccentric cam receptacle 113 in FIGS. 8 to 10.

FIG. 14 of another embodiment corresponds to FIG. 8. Specifically, before the eccentric cam head 311 contacts and pushes the lower receiving section 113*b* downward as shown in FIG. 8, that is, in the negative Y-axis direction, the housing 11 is located at the uppermost position as shown in FIG. 14. At this time, it is preferable that the height of the inner space of the guide member 12 according to another embodiment of the present disclosure corresponds to the height of the blade housing 11, that is, equal thereto or to be larger than that by an offset amount. However, unlike the at least one embodiment of the present disclosure, the upper part of the guide member 12 is opened. Therefore, the blade housing 11 according to another embodiment of the present disclosure protrudes upwardly with respect to the guide member 12, that is, in the Y-axis direction, as shown in FIG. 14.

FIG. 15 of another embodiment corresponds to FIG. 9. Specifically, when the eccentric cam head 311 pushes the lower receiving section 113*b* gradually downward as shown in FIG. 9, that is, in the negative Y-axis direction, the blade housing 11 slides and linearly moves downward with respect to the guide member 12 as shown in FIG. 15, that is, in the negative Y-axis direction.

FIG. 16 of another embodiment corresponds to FIG. 10. Specifically, when the lower receiving section 113*b* is positioned at the lowermost position as shown in FIG. 10, the blade housing 11 is also located at the lowermost position with respect to the guide member 12, as shown in FIG. 16. At this time, the lower frame side 112*d* of the blade housing 11 comes close to the rubber guard 122 of the guide member 12, as described with reference to FIG. 5.

Figure 17:
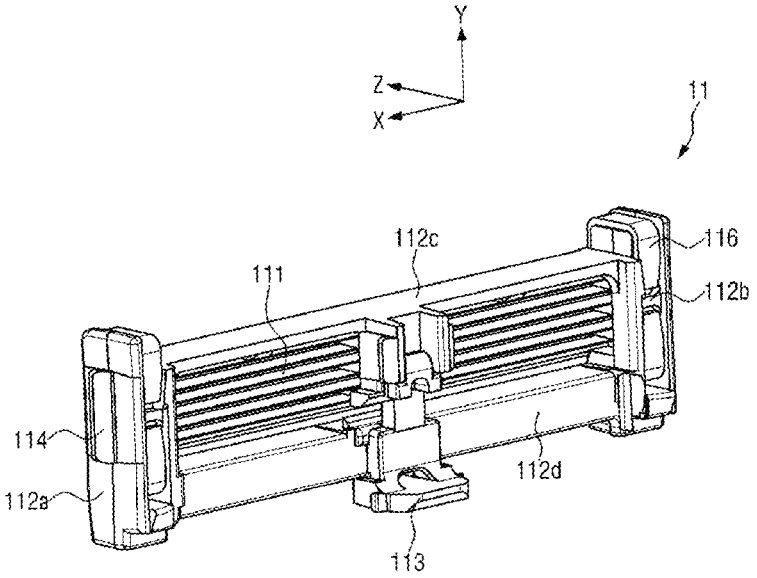
FIG. 17 is a rear perspective view of a blade housing according to yet another embodiment of the present disclosure.

FIG. 17 is a rear perspective view of a blade housing 11 according to yet another embodiment of the present disclosure.

As described above, the eccentric cam receptacle 113 is formed on the rear surface of the blade housing 11 so as to be able to contact the power unit 30. However, according to yet another embodiment of the present disclosure, the eccentric cam receptacle 113 includes only the lower receiving section 113 without an upper receiving section.

According to at least one embodiment of the present disclosure, the eccentric cam head 311 of the eccentric cam 31 is inserted into the space formed between the upper receiving section 113*a* and the lower receiving section 113*b*, as will be described in detail below. Rotation of the eccentric cam head 311 enables the drive of the power unit 30 to be transmitted to the cartridge 10.

Whereas, according to yet another embodiment of the present disclosure, there is no upper receiver, and thus, the eccentric cam head 311 cannot transmit the rotational force to the upper direction when rotating. Therefore, when the blade housing 11 is positioned at the lowermost position with respect to the guide member 12, even with the eccentric cam head 311 rotating, the blade housing 11 does not slide and linearly move relative to the guide member 12.

At this time, when the user cuts the body/facial hairs, frictional force is generated above the cartridge 10 while the skin-contact face SF of the cartridge 10 comes in contact with the skin. This frictional force enables the blade housing 11 to slide with respect to the guide member 12 and to linearly move upwardly, that is, in the Y-axis direction. After the blade housing 11 linearly moves upward, when the eccentric cam head 311 gradually pushes the lower receiving section 113 downward, that is, in the negative Y-axis direction, the blade housing 11 also slides with respect to the guide member 12, and linearly moves downward, that is, in the negative Y-axis direction.

In other words, yet another embodiment of the present disclosure has the eccentric cam receptacle 113 formed only at the lower portion of the eccentric cam head 311, so that the eccentric cam receptacle 113 is controlled exclusively by the downward components of the rotational force of the eccentric cam head 311. However, since the eccentric cam receptacle 113 does not contact the upper, left, and right portions of the eccentric cam head 311, it is not controlled by the upward, leftward and rightward components of the rotational force. Therefore, the eccentric cam receptacle 113 is influenced only by the downward component of the rotational force of the eccentric cam head 311.

Figure 18:
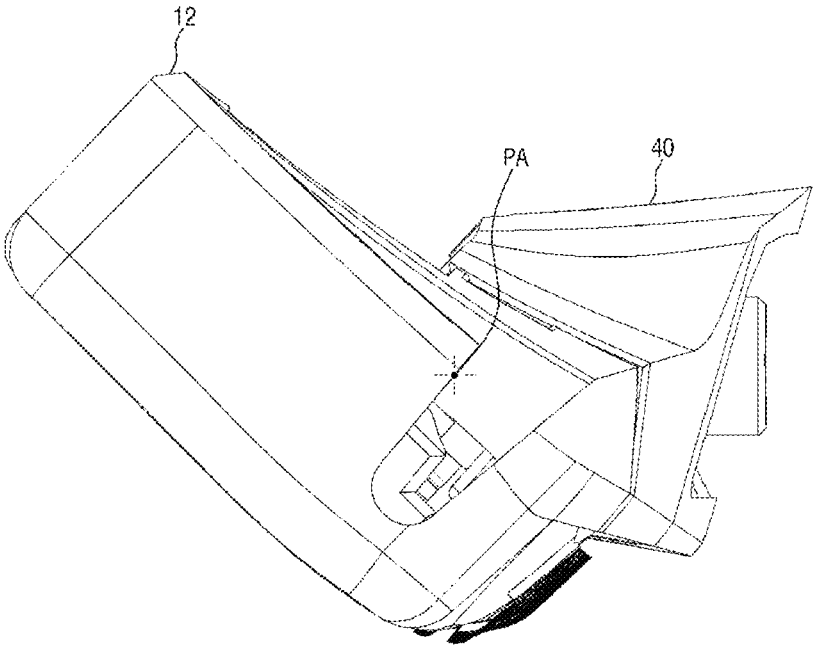
FIG. 18 is a side view of a cartridge being positioned in the initial state according to at least one embodiment of the present disclosure, when an eccentric cam head is at the lowermost position.
Figure 19:
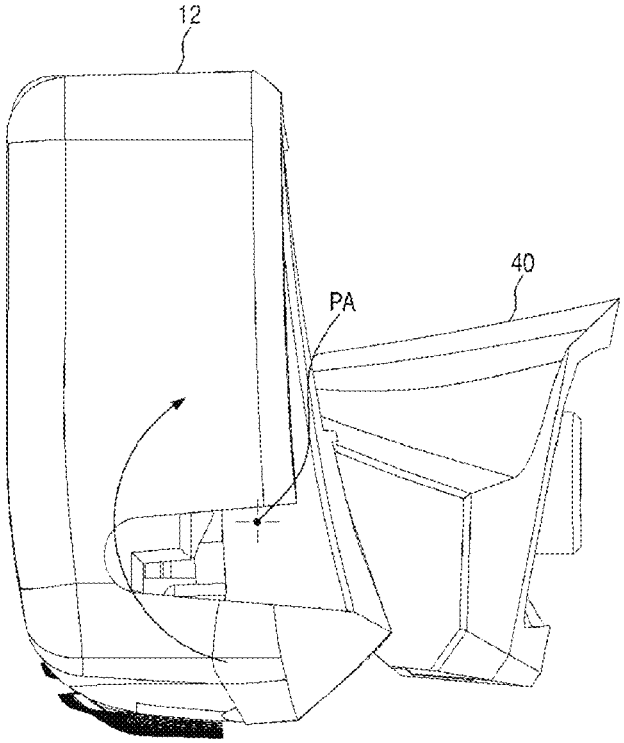
FIG. 19 is a side view of the cartridge shown in FIG. 18, after being pivoted.
Figure 20:
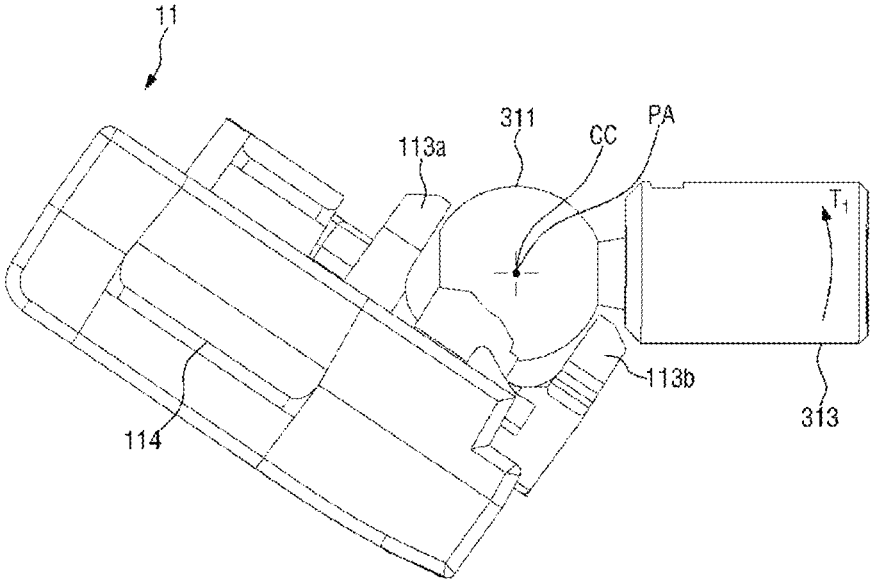
FIG. 20 is a side view of the cartridge shown in FIG. 18 without a guide member and a cartridge connector.
Figure 21:
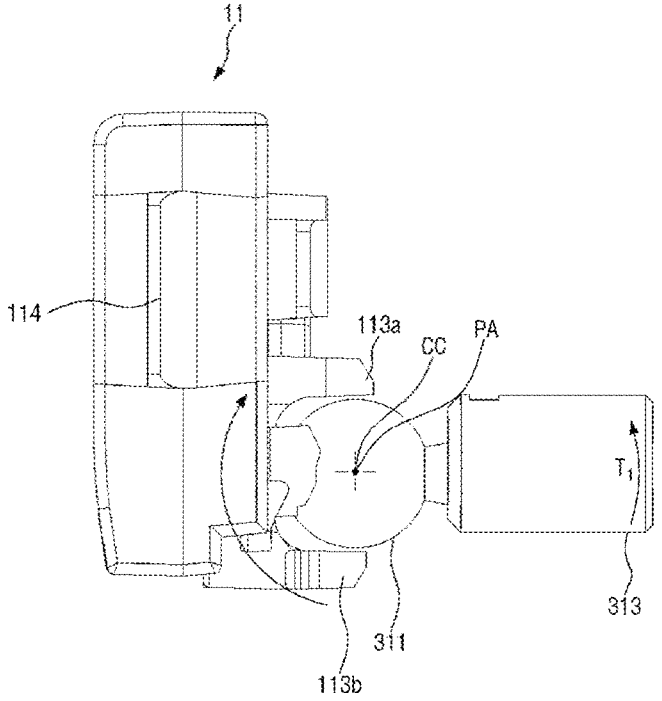
FIG. 21 is a side view of a blade housing shown in FIG. 20, after being pivoted.

FIG. 18 is a side view of the cartridge 10 being positioned in the initial state according to at least one embodiment, when the eccentric cam head 311 is at the lowermost position. FIG. 19 is a side view of the cartridge 10 shown in FIG. 18, when pivoted. FIG. 20 is a side view of the cartridge 10 shown in FIG. 18 without the guide member 12 and the cartridge connector 40. FIG. 21 is a side view of the blade housing 11 shown in FIG. 20, when pivoted. Here, the initial state refers to a state of the motor 32 before rotation. According to at least one embodiment of the present disclosure, in the initial state, the skin-contact face SF of the cartridge 10 establishes an acute angle with respect to rotational axis MA of the motor 32. However, the initial state may be varied according to various embodiments of the present disclosure. A detailed description thereof will follow.

As described above, the cartridge connector 40 interconnects the guide member 12 and the handle 20 and provides a pivot axis PA for the cartridge 10 to pivot. Referring back to FIG. 2, the cartridge connector 40 is formed on both sides with bosses 41 protruding outwardly. The guide member 12 is formed on both sides with boss grooves 123, respectively. The cartridge connector 40 and the guide member 12 may be coupled by inserting the bosses 41 formed in the cartridge connector 40 into the boss grooves 123 formed in the guide member 12. As shown in FIGS. 18 and 19, the cartridge 10 pivots about the bosses 41 of the cartridge connector 40. Thus, pivot axis PA, which is the center of the pivoting of the cartridge 10, is established interconnecting the bosses 41 formed on both sides of the cartridge connector 40 as shown in FIG. 2.

The arrangement of FIG. 20 corresponds to that of FIG. 18, and the arrangement of FIG. 21 corresponds to that of FIG. 19. In other words, pivot axis PA, when the eccentric cam head 311 is positioned at the lowermost position as shown in FIG. 18, occupies its highest relative position with respect to the center CC of the eccentric cam head 311. Therefore, when the eccentric cam head 311 is moved upward gradually while rotating, pivot axis PA moves downward relatively with respect to the central axis CA of the eccentric cam head 311.

It is preferable that the pivot axis PA is positioned to pass through the eccentric cam head 311. It is more preferable that the pivot axis PA passes through center CC of the eccentric cam head 311, but the embodiment is not limited thereto. This is because the eccentric cam head 311 being captured within the eccentric cam receptacle 113 is susceptible to fall out of the eccentric cam receptacle 113 when the cartridge 10 pivots, provided that pivot axis PA is positioned off the line extending through the eccentric cam head 311, possibly resulting in failed delivery of the drive for linearly moving the blade housing 11. Even if the arrangement of pivot axis PA being positioned off the line extending through the eccentric cam head 311 does not necessarily result in complete disengagement of the eccentric cam head 311 from the eccentric cam receptacle 113 when the cartridge 10 pivots, such eccentric arrangement as triggered by the pivoting cartridge 10 causes unnecessary interference to be increased between the eccentric cam head 311 and the eccentric cam receptacle 113, to restrict the range of up and down movements of the blade housing 11 or increase noise, leading to decreased comfort when the razor is used.

The pivot axis PA may pass through center CC of the eccentric cam head 311, but the embodiment is not limited thereto, and it may be located close to the eccentric cam head 311. When the pivoting of the cartridge 10 occurs with pivot axis PA lying at center CC of the eccentric cam head 311, constant distance can be maintained between the contact portions of the eccentric cam receptacle 113 and eccentric cam head 311. Therefore, elimination of unnecessary interference between the eccentric cam head 311 and the eccentric cam receptacle 113 permits the blade housing 11 provided with the eccentric cam receptacle 113 to be smoothly pivoted up and down without jolting. Therefore, coinciding pivot axis PA with center CC of the eccentric cam head 311 is superior to the eccentric arrangement therebetween in providing a sense of security with an increased closeness.

Although not shown in the drawings, when the eccentric cam head 311 is located at the uppermost position, the pivot axis PA is located at the lowest position relative to central axis CA of the eccentric cam head 311. Therefore, as the eccentric cam head 311 gradually moves downward while rotating, the pivot axis PA relatively moves upwards with respect to central axis CA of the eccentric cam head 311.

Meanwhile, the bosses 41 of the cartridge connector 40 have a round cylinder shape as shown in FIG. 2. This is to facilitate a smooth contact between the bosses 41 and the boss grooves 123, when the cartridge 10 pivots about the bosses 41. However, the present disclosure is not limited to this, and the bosses 41 may have a partial surface curved into a columnar shape. The sizes of the bosses 41 and the bosses 123 correspond to each other. More specifically, the size of the bosses 123 is larger than the size of the bosses 41. Preferably, the cartridge 10 is restrained with respect to the cartridge connector 40 against movement other than pivoting. On the other hand, one side of the cartridge connector 40 is fixedly coupled with the handle 20, resulting in the cartridge 10 pivoting with respect to the handle 20.

Figure 22:
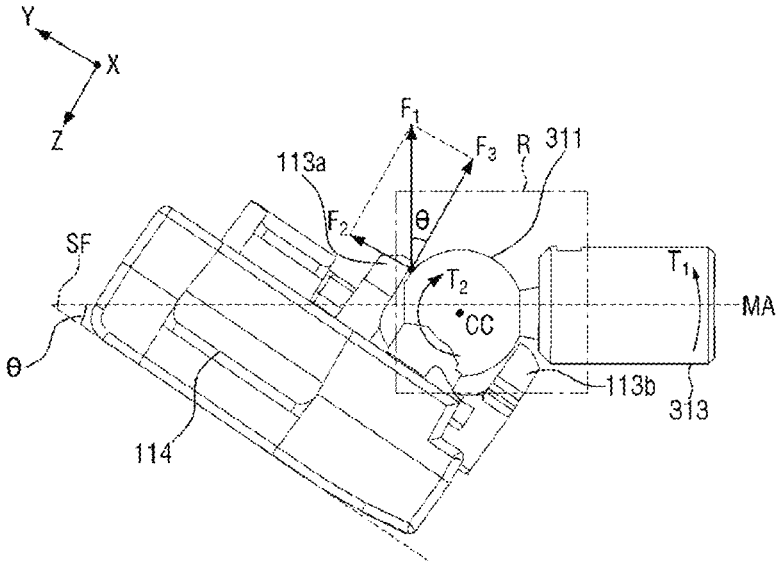
FIG. 22 is a side view of a cartridge being subjected to a torque T2 generated by the drive of a motor, when an angle θ is an acute angle between a skin-contact face SF of the cartridge 10 and a rotational axis MA of the motor.

FIG. 22 is a side view of the cartridge 10 being subjected to a torque $T_2$ generated by the drive of the motor 32, when an angle θ is an acute angle between skin-contact face SF of the cartridge 10 and rotational axis MA of the motor 32.

As described above, the initial state means that the motor 32 does not rotate. When angle θ between skin-contact face SF of the cartridge 10 and rotational axis MA of the motor 32 is an acute angle and the motor 32 starts to rotate, a force acts on the upper receiving section 113*a*, as shown in FIG. 22. Specifically, the eccentric cam head 311, when moving upward, generates $F_1$ which is an upward component of the rotational force of the eccentric cam head 311. $F_1$ may be divided into $F_2$ which is the component in the Y-axis direction of the cartridge 10, and $F_3$ which is the component in the negative Z-axis direction of the cartridge 10. Since $F_2$ and $F_3$ are the component forces of $F_1$, they can be expressed as follows.

$$F_2 = F_1 \sin\theta$$

$$F_3 = F_1 \cos\theta \qquad \text{Equation 1}$$

Here, θ is the angle formed by the skin-contact face SF of the cartridge 10 and the rotational axis MA of the motor 32, as shown in FIG. 22. As described above, when the eccentric cam head 311 moves upward while rotating, the upper receiving section 113*a* is pushed up in the Y-axis direction, and the blade housing 11 linearly moves. The force that pushes up the upper receiving section 113*a* in the Y-axis direction is the component force of $F_2$ in the Y-axis direction of $F_1$. By the way, by component force $F_3$ in the negative Z-axis direction of $F_1$, the upper receiving section 113*a* is also forced in the negative Z-axis direction. The action of $F_2$ and $F_3$ generates torque $T_2$ to allow the cartridge 10 to be automatically pivoted. Specifically, the equation of torque $T_2$ acting on the cartridge 10 is as follows.

$$T_2 = \sum r \times F = (r_3 \times F_3) + (r_2 \times F_2) = (r_3 \times F_1 \cos\theta) + (r_2 \times F_1 \sin\theta) \quad \text{Equation 2}$$

Here, the positive (+) direction of the torque is set as the clockwise direction. The components corresponding to r and F are all vectors, and x denotes a vector product. In addition, $r_2$ is the vertical distance from pivot axis PA to $F_2$, and $r_3$ is the vertical distance from pivot axis PA to $F_3$. As described above, each time the eccentric cam head 311 rotates, the relative position of pivot axis PA changes, so that $r_2$ and $r_3$ can also change. However, since $r_2$ is a relatively miniscule value, its changes are ignorable.

$$r_2 \approx 0 \quad \text{Equation 3}$$

Therefore, torque $T_2$ is calculated as follows.

$$T_2 \approx r_3 \times F_1 \times \cos\theta \quad \text{Equation 4}$$

As can be seen from Equation 4, the smaller the angle θ between the skin-contact face SF and the rotational axis MA in the initial state, the larger the torque $T_2$. However, if the torque $T_2$ is excessively large, the user's shaving comfort is reduced, and the user may feel uncomfortable. Therefore, it is not preferable to set angle θ between skin-contact face SF and rotational axis MA to be excessively small in the initial state. Empirically, in order to enhance the user's shaving comfort, angle θ is preferably formed to be 30 to 60 degrees in the initial state by skin-contact face SF and rotational axis MA according to an embodiment of the present disclosure. Empirically, angle θ larger than 60 degrees reduces the user's shaving comfort or renders the user to feel uncomfortable. Angle θ smaller than 30 degrees considerably reduces the linear motion amplitude of the blade housing 11, making it hard to obtain the effect of the present disclosure, and the lower receiving section 113*b* may be interfered by the eccentric cam neck 312. More preferably, angle θ formed by skin-contact face SF and rotational axis MA may be 40 to 50 degrees.

Figure 23:
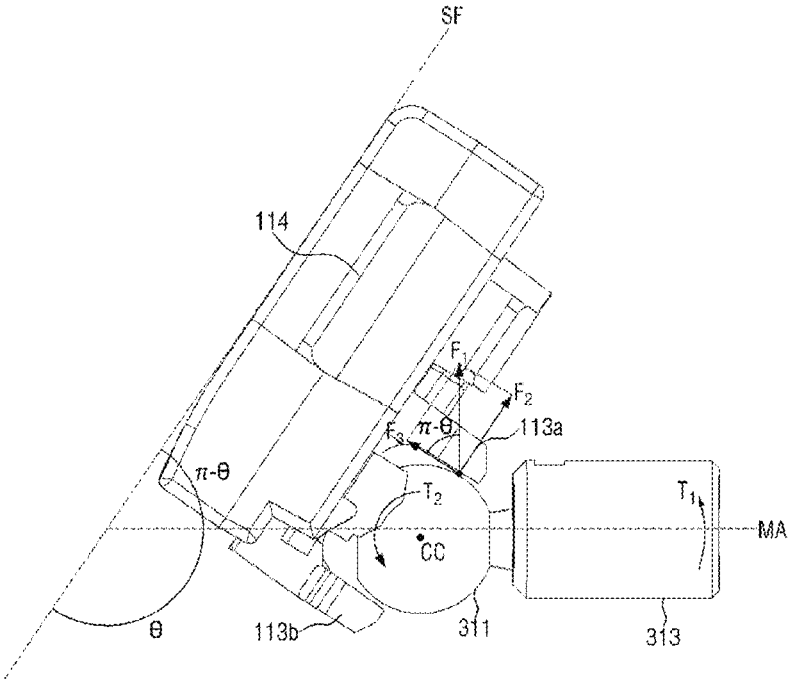
FIG. 23 is a side view of a cartridge being subjected to torque T2 generated by the drive of a motor, when angle θ is an obtuse angle between skin-contact face SF of the cartridge and rotational axis MA of the motor.

FIG. 23 is a side view of the cartridge 10 being subjected to torque $T_2$ generated by the drive of motor 32, when angle θ is an obtuse angle between skin-contact face SF of the cartridge 10 and rotational axis MA of the motor 32.

When angle θ between skin-contact face SF of the cartridge 10 and rotational axis MA of the motor 32 is an obtuse angle and the motor 32 starts to rotate, the eccentric cam head 311 moving upward generates $F_1$ which is an upward component of the rotational force of the eccentric cam head 311, as shown in FIG. 23. $F_1$ may be divided into $F_2$ which is the component in the Y-axis direction of the cartridge 10 and $F_3$ which is the component in the Z-axis direction of the cartridge 10. Since $F_2$ and $F_3$ are the component forces of $F_1$, they can be expressed as follows.

$$F_2 = F_1 \sin(\pi - \theta) = F_1 \sin\theta$$

$$F_3 = F_1 \cos(\pi - \theta) = -F_1 \cos\theta \quad \text{Equation 5}$$

At this time, the equation of torque $T_2$ is as follows.

$$T_2 = \sum r \times F = (r_3 \times F_3) + (r_2 \times F_2) = (r_3 \times F_1 \cos(\pi - \theta)) + (r_2 \times F_1 \sin(\pi - \theta)) = (r_3 \times -F_1 \cos\theta) + (r_2 \times F_1 \sin\theta) \approx r_3 \times F_1 \times \cos\theta \quad \text{Equation 6}$$

Here, too, the positive (+) direction of the torque is set as the clockwise direction. However, cos θ is a negative number because angle θ between skin-contact face SF and rotational axis MA is an obtuse angle. Therefore, torque $T_2$ is also negative and acts counterclockwise. In addition, $r_2$ is a relatively miniscule value and can be ignored.

As can be seen from Equation 6, the smaller the angle θ between the skin-contact face SF and the rotational axis MA in the initial state, the larger the torque $T_2$. However, if the torque $T_2$ is excessively large, the user's shaving comfort is reduced, and the user may feel uncomfortable. Therefore, it is not preferable to set angle θ between skin-contact face SF and rotational axis MA to be excessively small in the initial state.

Figure 24:
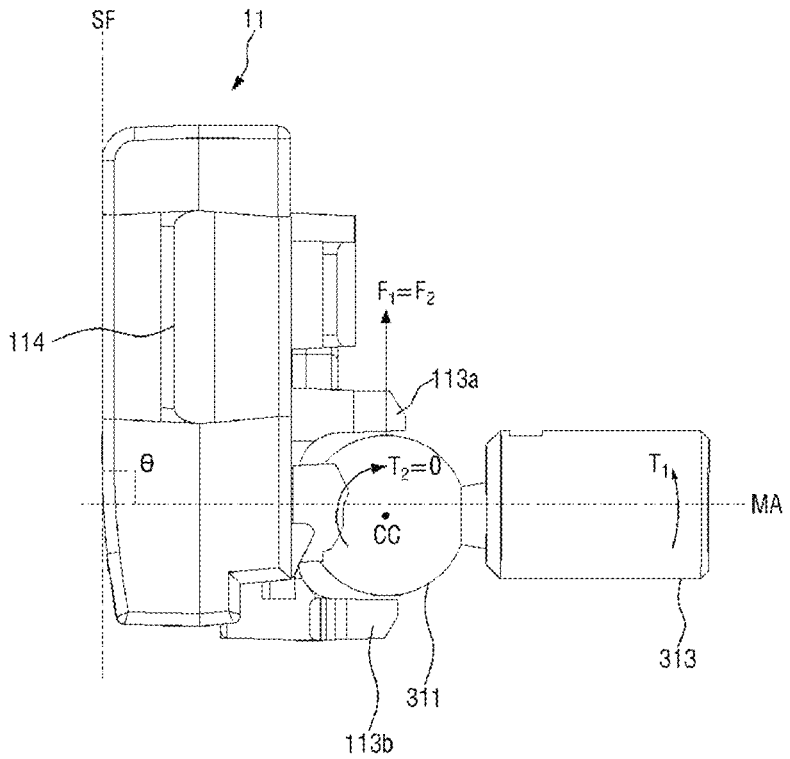
FIG. 24 is a side view of a cartridge not being subjected to torque T2 generated by the drive of a motor, when angle θ is a right angle between skin-contact face SF of the cartridge and rotational axis MA of the motor.

FIG. 24 is a side view of the cartridge 10 not being subjected to torque $T_2$ generated by the drive of the motor 32, when angle θ is a right angle between skin-contact face SF of the cartridge 10 and rotational axis MA of the motor 32.

When angle θ between skin-contact face SF of the cartridge 10 and rotational axis MA of the motor 32 is a right angle and the motor 32 starts to rotate, the eccentric cam head 311 moving upward generates $F_1$ which is an upward component of the rotational force of the eccentric cam head 311, as shown in FIG. 24. In this case, the upper side of the eccentric cam head 311 and the upper side of the cartridge 10, that is, they are commonly directed toward the Y-axis direction. Therefore, since $F_1$ acts only in the Y-axis direction, $F_2$ and $F_1$, which are the forces in the Y-axis direction, are the same. On the other hand, since $F_1$ does not act in the Z-axis direction at all, $F_3$, which is the force in the Z-axis direction, becomes zero.

$$F_2 = F_1 \sin\theta = F_1 \sin 90° = F_1$$

$$F_3 = F_1 \cos\theta = F_1 \cos 90° = 0 \quad \text{Equation 7}$$

At this time, the equation of torque $T_2$ is as follows.

$$T_2 = \sum r \times F = (r_3 \times F_3) + (r_2 \times F_2) = (r_2 \times F_1 \sin\theta) \approx 0 \quad \text{Equation 8}$$

Since $r_2$ is a relatively miniscule value, it can be ignored. As Equation 8 tells, torque $T_2$ does not occur when the angle θ formed by skin-contact face SF of the cartridge 10 and rotational axis MA of the motor 32 is a right angle.

As explained through various embodiments of the present disclosure, the magnitude of torque $T_2$ varies according to angle θ formed by the skin-contact face SF and the rotational axis MA. However, in the embodiments, the cartridge 10 is automatically pivoted by the motor 32 when rotating so that angle θ between the skin-contact face SF and the rotational axis MA becomes a right angle. However, when angle θ formed by the skin-contact face SF and the rotational axis MA is a right angle from the initial state, it is no longer necessary for the cartridge 10 to pivot automatically, so that torque $T_2$ will not be generated.

The initial state of the cartridge 10 according to various embodiments of the present disclosure is most preferable when the angle θ between the skin-contact face SF and the rotational axis MA is an acute angle. This offers the best comfort in use and the natural angle when the user grasps the razor 1 by hand and cuts the body/facial hairs. However, as described above, if the torque $T_2$ is excessively large, the user's shaving comfort is reduced. Therefore, when the initial state of the cartridge 10 is set as the state where the angle θ formed by the skin-contact face SF and the rotational axis MA is an acute angle, the cartridge connector 40 is provided with a restoration unit for which at least one cantilever 125 is used by this embodiment, as will be explained below. The above description does not limit the scope of the present disclosure, and the razor 1 of the present disclosure can include various embodiments.

Figure 25:
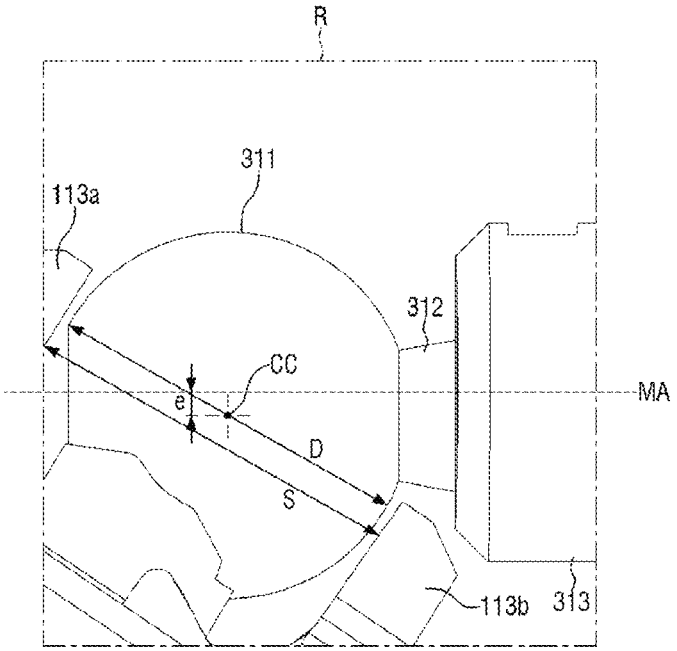
FIG. 25 is an enlarged, partial view of a region R shown in FIG. 22.

FIG. 25 is an enlarged, partial view of a region R shown in FIG. 22.

As described above, the eccentric cam head 311 is inserted into the space between the upper receiving section 113*a* and the lower receiving section 113*b* of the eccentric cam receptacle 113 so that the power of the power receiving portion 113 is transmitted to the cartridge 10. Distance (e) is constant between rotational axis MA and the central axis CA of the eccentric cam head 311. This is because the eccentric cam head 311 is eccentrically connected to the rotational axis MA. Distance (e) between the rotational axis MA and the central axis CA of the eccentric cam head 311 is an eccentricity (e) of the eccentric cam head 311.

The upper receiving section 113*a* and the lower receiving section 113*b* are formed side by side with a predetermined distance or interval therebetween and are parallel to the upper frame side 112*c* and the lower frame side 112*d*. The predetermined distance in the space between the upper receiving section 113*a* and the lower receiving section 113*b* is represented by length S which corresponds to the diameter D of the eccentric cam head 311, so that the eccentric cam head 311 can easily enter the space.

While the upper receiving section 113*a* and the lower receiving section 113*b* are spaced by the length S which corresponds to the diameter D of the eccentric cam head 311, there exists some difference between length S and diameter D such that the eccentric cam head 311 rotates smoothly, as shown in FIG. 25.

$$t = \frac{S - D}{2} \qquad \text{Equation 9}$$

$$\text{Amplitude} = (e \times \sin\theta) - t$$

Here, S denotes a length of a predetermined interval formed in the eccentric cam receptacle 113, D denotes a diameter of the eccentric cam head 311, and t denotes the difference in length between the eccentric cam receptacle 113 and the eccentric cam head 311, as calculated by the average of the differences between the upper receiving section 113*a* and the lower receiving section 113*b*. The amplitude is that of the blade housing 11 when reciprocating.

As indicated in Equation 9, the amplitude of the reciprocating motion depends on angle θ between the skin-contact face SF and the rotational axis MA, the eccentricity (e) of the eccentric cam head 311, and the aforementioned difference in length. If the amplitude is too small, the efficiency of hair cutting is not remarkably enhanced, and if the amplitude is too large, the user's shaving comfort is reduced. Therefore, by empirically adjusting the above conditions, the most appropriate amplitude can be set.

Figure 26:
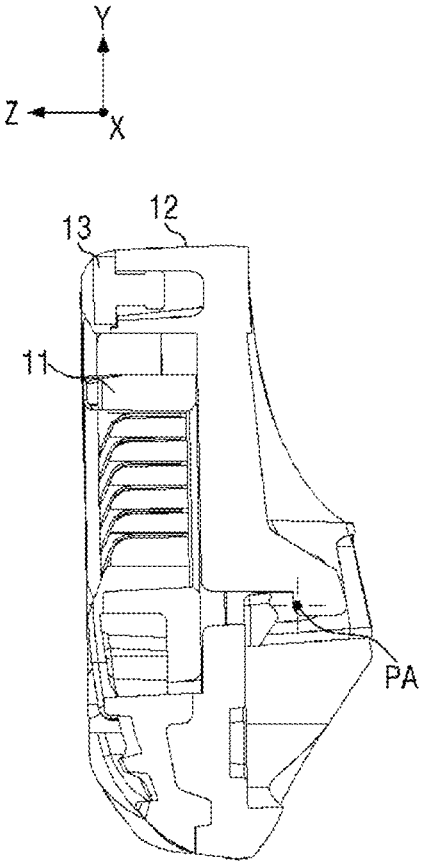
FIG. 26 is a cross-sectional side view of a cartridge according to at least one embodiment of the present disclosure, taken along line K-K' in FIG. 4.
Figure 27:
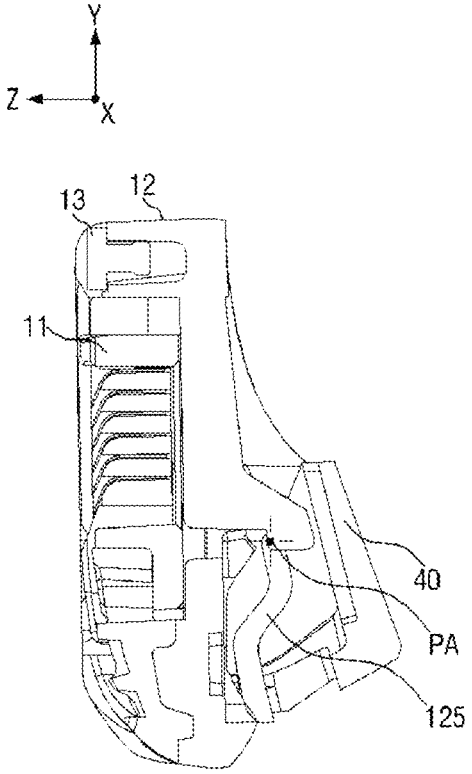
FIG. 27 is a cross-sectional side view of a cartridge connector coupled to the cartridge shown in FIG. 26.

FIG. 26 is a cross-sectional side view of the cartridge 10 according to at least one embodiment of the present disclosure, taken along line K-K' in FIG. 4, and FIG. 27 is a cross-sectional side view of the cartridge connector 40 coupled to the cartridge 10 shown in FIG. 26.

As shown in FIG. 27, the cartridge connector 40 includes at least one cantilever 125. The cantilever 125 serves to restore the cartridge 10 to its initial condition in case the cartridge 10 is excessively pivoted by the user in shaving or when torque $T_2$ is excessively generated in the initial state. The cantilever 125 is attached to the front of the cartridge connector 40, and it protrudes forward, that is, toward the Z-axis direction.

The cantilever 125 may be formed from the inside of the cartridge connector 40 toward the cartridge 10, that is, toward the Z-axis direction, as shown in FIG. 27. Alternatively, the cantilever 125 may extend from the lower end of the upper frame side 112*c* that supports the upper section of the guide member 12. In other words, as long as the cantilever 125 can restore the cartridge 10 when rotating to its initial state, it may be formed at various positions without limitation.

The cantilever 125 may be formed as shown in FIG. 27, to extend upward from below the cartridge connector 40, i.e., in the y-axis direction, and then bend so as to be in terminally contact with the cartridge 10. Alternatively, the cantilever 125 may have the shape of a curved surface having a predetermined curvature, wherein the curved surface may be configured to have only a positive slope or inclination with respect to the Z axis, or may have a slope of zero or more. In addition, the cantilever 125 may have a curved surface having a shape in which the inclination decreases toward the rear of the guide member 12, that is, in the negative Z-axis direction. Various other shapes are envisioned without limitation to what is illustrated herein.

In addition, two cantilevers 125 may be formed, one on the left side and the other on the right side of the cartridge connector 40, but the configuration is not limited thereto, and one or more than three cantilevers 125 may be formed.

As shown in FIG. 27, the cantilever 125 is protruded to contact and support the guide member 12. When the cartridge 10 pivots, the cantilever 125's contact area with the guide member 12 increases, the cantilever 125 is subjected to a force in the z-axis direction, and eventually the cantilever 125 having elasticity pushes the guide member 12 outward. This can support the cartridge 10 so as not to pivot beyond a certain angle, thereby further enhancing the comfort of the user using the razor. At this time, the cantilever 125 is desirably made of a material having elasticity to absorb the impact force. Therefore, even after the cantilever 125 is brought into contact with the barrier (not shown), some deformation occurs, so that some of the impact force can be absorbed. With its elasticity, the cantilever 125 can be restored to its original shape.

Figure 28:
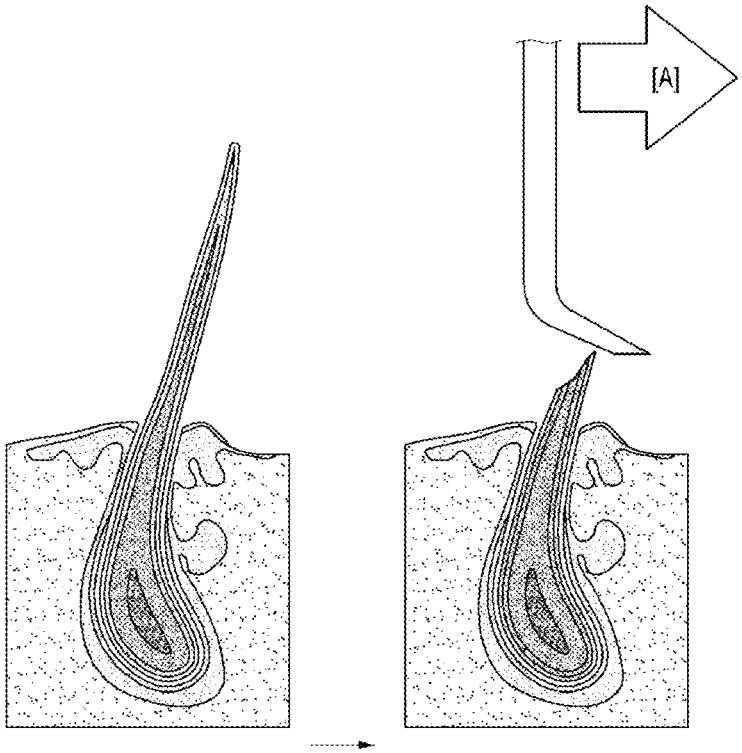
FIG. 28 is a schematic view of a hair cutting process using a conventional razor.
Figure 29:
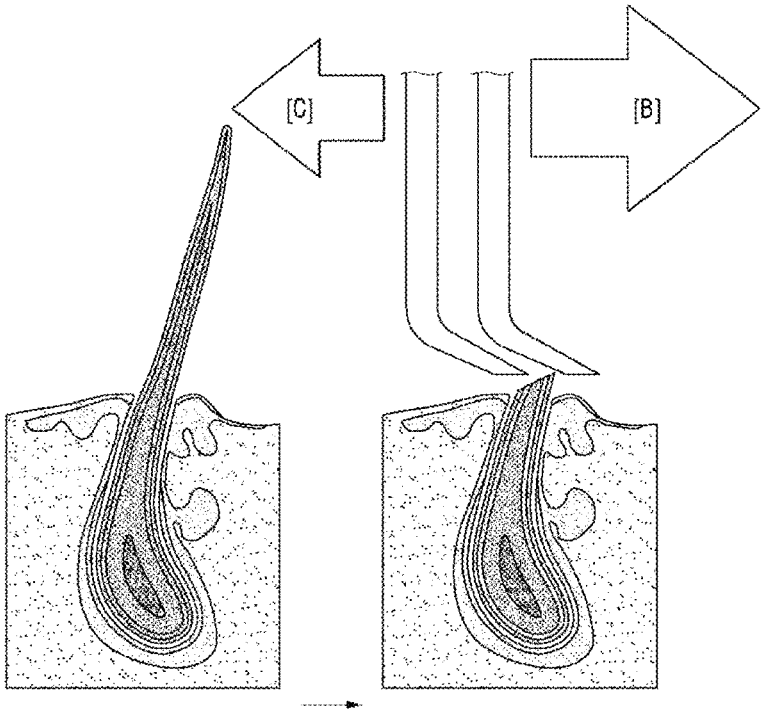
FIG. 29 is a schematic view of a hair cutting process using a razor according to some embodiments of the present disclosure.
Figure 30:
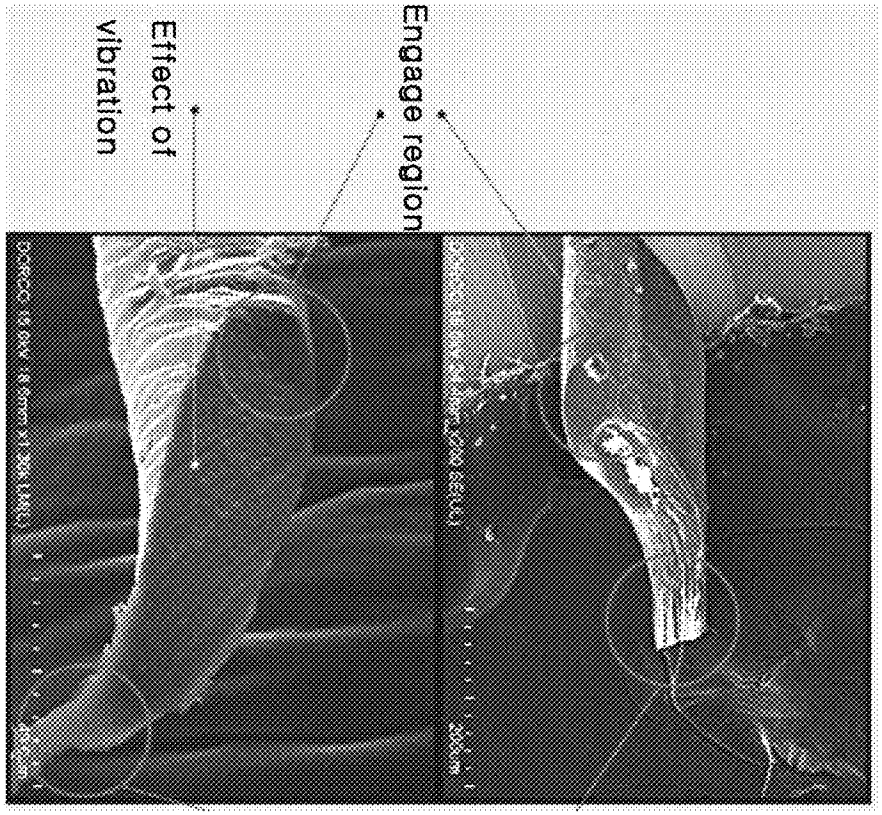
FIG. 30 is a photograph taken by a scanning electron microscope (SEM) showing a section of a hair cut using a conventional razor.
Figure 31:
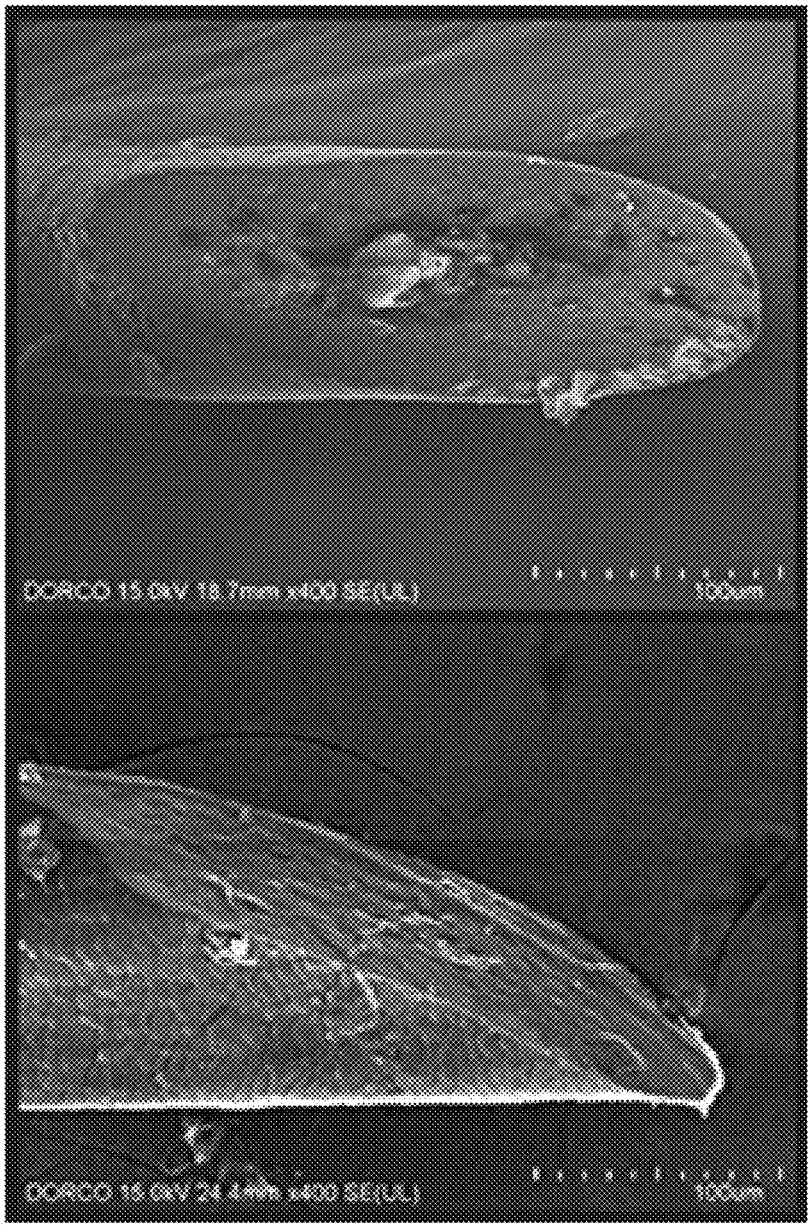
FIG. 31 is a photograph taken by the SEM showing a section of a hair cut using a razor according to some embodiments of the present disclosure.

FIG. 28 is a schematic view of a hair cutting process using a conventional razor, and FIG. 29 is a schematic view of a hair cutting process using the razor 1, according to some embodiments of the present disclosure. FIG. 30 is an SEM photograph of a section of the body/facial hairs cut using a conventional razor. FIG. 31 is an SEM photograph of a section of the body/facial hair cut using the razor 1 according to some embodiments of the present disclosure.

The ideal cutting direction of the hair is generally perpendicular to the direction of hair formation. This is because the area of the cross section is small and the appearance is most clean.

As shown in FIG. 28, when using a conventional razor, which has a cartridge, like 10 in the drawings, provided with blades like 111 in a frame like 112, to perform the body/facial hairs cutting once, the frame first contacts the body/facial hairs before the blades do. Then, the frame forcibly bend the body/facial hair toward the skin surface. Subsequent cutting of the hairs by the blades leaves the hairs cut in a direction with a little angular difference between the direction in which the hair is formed. In addition, the hair is not sharply cut by the blades but is forcibly pulled by the user. Such a result is shown in FIG. 30, where a so-called tugging phenomenon occurs, i.e., the area of the cross section of the hair is widened and the end of the cross section is elongated and messy.

With the razor 1 according to at least one embodiment of the present disclosure, however, the user can perform the body/facial hair cutting in contact with the skin at a manual speed of the body/facial hair cutting by the user, which is accelerated by the automatic linear motion of the blade housing 11, as shown in FIG. 29, accelerating the body/facial hair cutting process, thereby increasing the hair cutting efficiency.

In addition, after being cut and curved toward the skin by passing of the blades 111 in direction B, the body/facial hairs get straightened back in the process of returning the blades 111 in direction C, allowing the body/facial hairs to be re-cut while the blades 111 pass again in direction B. This means that multiple haircutting cycles are offered for each shaving action.

Specifically, when the blades 111 move in direction B, the speed of moving the razor 1 by hand is combined with the speed of moving the blades 111 by the rotational force of the motor 32, which accelerates the body/facial hair cutting. Thus, the body/facial hairs are subjected to more force when they are cut, resulting in a cleaner cross-section of the body/facial hairs cut, as shown in FIG. 31.

With the razor of the present disclosure, the improved hair cutting ability combined with the pivoting of the cartridge 10 further enhances the user's shaving comfort. Generally, the angle at which the body/facial hairs is cut the best along the skin surface varies. Unless the pivoting is combined, the user would need to adjust the cartridge 10 to closely follow the skin surface to perform the body/facial hair cutting. With the pivoting cartridge 10, the razor 1 according to at least one embodiment of the present disclosure changes the angle of the body/facial hair cutting along the skin surface without an input from the user. Therefore, the user's shaving comfort is enhanced, and the body/facial hair cutting can be performed more quickly and accurately.

It will be understood by those skilled in the art that the present disclosure may be embodied in other specific forms without departing from the technical idea or essential characteristics thereof. It is therefore to be understood that the above-described embodiments are illustrative in all aspects and not restrictive. The scope of the present disclosure is defined by the appended claims rather than the detailed description, and all changes or modifications derived from the meaning and scope of the claims and their equivalents are to be construed as being included within the scope of the present disclosure.

The invention claimed is:

1. A razor, comprising:

a handle;

a motor disposed in the handle and configured to provide rotational power;

a rotating shaft assembly coupled to the motor and configured to be rotated by the rotational power;

a cartridge including a blade housing on which one or more blades are seated; and an eccentric cam receptacle formed at a rear surface of the blade housing and configured to be in contact with the rotating shaft assembly to cause the blade housing to perform a linear movement in response to rotation of the rotating shaft assembly, wherein the cartridge is coupled to the handle such that the cartridge is pivotable about a pivot axis perpendicular to a rotational axis of the rotating shaft assembly, wherein the pivot axis passes through the rotating shaft assembly, wherein the rotating shaft assembly is configured to press the eccentric cam receptacle, during rotation of the rotating shaft assembly, toward a shaving direction of the razor in which the one or more blades cut hair, wherein the rotating shaft assembly includes an eccentric cam head eccentrically connected to the rotating shaft assembly so that a central axis of the eccentric cam head does not coincide with a rotation axis of the rotating shaft assembly, and wherein a position of the eccentric cam receptacle is fixed relative to the one or more blades so that the eccentric cam receptacle and the one or more blades move up and down in a same direction.

2. The razor of claim 1, further comprising a cartridge housing configured to guide the linear movement of the blade housing.

3. The razor of claim 2, further comprising:

a rail at each side of the cartridge housing; and a slider bar at each corresponding side of the blade housing, wherein the cartridge housing guides the linear movement of the blade housing as the slide bars move along the rails.

4. The razor of claim 3, wherein one end of each slide bar has a chamfer shape for reducing an area of contact with a corresponding rail.

5. The razor of claim 1, wherein the rotating shaft assembly comprises:

an eccentric cam head having at least a partially curved outer surface.

6. The razor of claim 2, further comprising a hinge assembly configured to:

couple the cartridge housing to the handle; and provide the pivot axis for the cartridge to pivot.

7. The razor of claim 6, wherein the hinge assembly comprises:

an elastic portion configured to restore the cartridge to an initial state when the cartridge is pivoted about the pivot axis.

8. The razor of claim 7, wherein the elastic portion has elasticity, and is configured to be in contact with a rear of the cartridge housing.

9. The razor of claim 6, wherein:

the hinge assembly comprises a boss protruding outwardly from each side thereof; and the cartridge housing comprises boss grooves each configured to engage a corresponding boss of the hinge assembly.

10. The razor of claim 9, wherein the pivot axis is aligned with the bosses engaged with the boss grooves.

11. The razor of claim 1, wherein the eccentric cam receptacle comprises:

an upper receiving section and a lower receiving section which protrude toward a rear of the blade housing, and wherein the upper receiving section and the lower receiving section are parallel and spaced apart by a predetermined distance.

12. The razor of claim 11, wherein the upper receiving section and the lower receiving section define a space therebetween in which the rotating shaft assembly is inserted.

13. The razor of claim 12, wherein the rotating shaft assembly is further configured to apply a force to the upper receiving section or the lower receiving section as it is rotated, causing the blade housing to perform the linear movement.

14. The razor of claim 1, wherein, in an initial state, an angle generated by a skin-contact surface of the cartridge and the rotational axis is in a range of about 30° to 60°.

15. A razor, comprising:

a handle;

a motor disposed in the handle;

a cartridge including a blade housing on which one or more blades are seated;

an eccentric cam receptacle formed at a rear surface of the blade housing; and a rotating shaft assembly configured to transmit power generated by the motor to the eccentric cam receptacle, causing the eccentric cam receptacle to move such that the blade housing performs a linear movement, wherein the cartridge is pivotably coupled to the handle about a pivot axis parallel to a longitudinal direction of the one or more blades, wherein the pivot axis passes through the rotating shaft assembly, wherein the rotating shaft assembly is configured to press the eccentric cam receptacle, during rotation of the rotating shaft assembly, toward a shaving direction of the razor in which the one or more blades cut hair, wherein the rotating shaft assembly includes an eccentric cam head eccentrically connected to the rotating shaft assembly so that a central axis of the eccentric cam head does not coincide with a rotation axis of the rotating shaft assembly, and wherein a position of the eccentric cam receptacle is fixed relative to the one or more blades so that the eccentric cam receptacle and the one or more blades move up and down in a same direction.

* * * * *